US008105101B2

(12) United States Patent
Kotera et al.

(10) Patent No.: US 8,105,101 B2
(45) Date of Patent: Jan. 31, 2012

(54) LAMP SOCKET AND LUMINAIRE WITH SAME

(75) Inventors: Ryusuke Kotera, Shibukawa (JP); Satoru Uehara, Agatsuma-gun (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 199 days.

(21) Appl. No.: 12/524,568

(22) PCT Filed: Jan. 22, 2008

(86) PCT No.: PCT/JP2008/050757

§ 371 (c)(1), (2), (4) Date: Jul. 25, 2009

(87) PCT Pub. No.: WO2008/090863

PCT Pub. Date: Jul. 31, 2008

(65) Prior Publication Data

US 2010/0027279 A1 Feb. 4, 2010

(30) Foreign Application Priority Data

Jan. 26, 2007 (JP) ..... 2007-017071
May 18, 2007 (JP) ..... 2007-133299

(51) Int. Cl.
*H01R 33/02* (2006.01)

(52) U.S. Cl. ..... 439/234; 439/241

(58) Field of Classification Search ..... 439/232, 439/233, 234, 236, 240, 241, 225; 362/269, 362/441, 448, 226
See application file for complete search history.

(56) References Cited

U.S. PATENT DOCUMENTS

| | | | | |
|---|---|---|---|---|
| 2,254,222 | A | 9/1941 | Hubbell et al. | |
| 2,303,156 | A | 11/1942 | Bryant at al. | |
| 2,569,662 | A | 10/1951 | Fallek | |
| 3,654,587 | A * | 4/1972 | McLaughlin | 439/241 |
| 6,364,679 | B1 * | 4/2002 | Gerstberger | 439/241 |
| 6,676,425 | B2 * | 1/2004 | Lewis | 439/234 |
| 7,568,930 | B2 * | 8/2009 | Brand et al. | 439/234 |
| 7,597,575 | B2 * | 10/2009 | Tufano et al. | 439/239 |
| 2004/0219814 | A1 | 11/2004 | Vogt et al. | |

FOREIGN PATENT DOCUMENTS

DE 817 325 C1 10/1951

(Continued)

OTHER PUBLICATIONS

International Search Report for the Application No. PCT/JP2008/050757 mailed Feb. 19, 2008.

*Primary Examiner* — Thanh Tam Le
(74) *Attorney, Agent, or Firm* — Cheng Law Group, PLLC

(57) ABSTRACT

A lamp socket has a mover and a supporter. At an open position, the supporter supports the mover so that the mover does not prevent a lamp from being moved to or from a mounting position along a specified direction. When the lamp can be moved from the mounting position along the specified direction, the supporter supports the mover so that the contacts do not make contact with lamp pins, respectively. At the close position, the supporter supports the mover so that the mover prevents the lamp from being moved from or to the mounting position along the specified direction. If the mover is at the close position, and the lamp is in a posture by which it can be moved from the mounting position along the specified direction in case of the open position, the supporter supports the mover so that the contacts make contact with the pins, respectively.

14 Claims, 17 Drawing Sheets

FOREIGN PATENT DOCUMENTS

| | | | |
|---|---|---|---|
| DE | 831 570 | C1 | 2/1952 |
| DE | 862 803 | C1 | 1/1953 |
| JP | 56-112884 | U | 8/1981 |
| JP | 56-112885 | U | 8/1981 |
| JP | 56-112886 | U | 8/1981 |
| JP | 2005-294239 | A | 10/2005 |

* cited by examiner

LAMP SOCKET AND LUMINAIRE WITH SAME

TECHNICAL FIELD

The invention relates generally to lamp sockets and, more particularly, to a lamp socket which is used for a lamp having lamp pins for power supply sticking out from one base and places and fixes the lamp at a mounting position of luminaire, and the luminaire.

BACKGROUND ART

A lamp, for example, a straight tube fluorescent lamp has two bases fixed at both ends of its lamp tube, respectively. Each of the bases has two lamp pins for power supply, projecting from its own end face in the length (axis) direction of the lamp tube. Such many kinds of lamp sockets for placing and fixing a lamp at a mounting position of a light fitting have been heretofore provided.

For example, there is a lamp socket having a socket case as well as two contacts and a rotator which are put in the case. The socket case is fixed to a body of luminaire. The two contacts can make contact with two lamp pins projecting from one end (base) of a lamp, respectively. The rotator is rotatably supported by the socket case. The socket case has a cylindrical side that is formed with a slit (fixed slit) through which the two lamp pins can pass. On the other hands, one surface of the rotator is a facing surface with a base of the lamp, and corresponds to one end face of the cylindrical socket case. The facing surface is also formed with a slit (rotary slit). Two contacts in the socket case are arranged such that the rotary slit intervenes, in the width direction of the rotary slit when the rotary slit is aligned with the fixed slit.

A procedure of attaching a lamp to luminaire having a pair of lamp sockets is explained. In each lamp socket, when the rotary slit is aligned with the fixed slit, two lamp pins are inserted into the socket case from the fixed slit along the rotary slit. The lamp is then rotated around the axis of the lamp tube (the projection direction of the lamp pins and the central axis of the base). Thereby, the two lamp pins are connected with the two contacts, respectively. At the same time, the two lamp pins are consequently unable to pass through the fixed slit. That is, the lamp is fixed to two lamp sockets, and the attachment of the lamp to the mounting position is finished. Also, if the lamp is rotated around the opposite direction when the lamp was attached, the two pairs of lamp pins can be pulled out of the fixed slits of the two lamp sockets, respectively. Therefore, the lamp can be removed from the mounting position.

Incidentally, in the above-stated lamp socket, a space for rotating a lamp at the mounting position by hand is required around the lamp. However, a structural member such as a reflector panel or the like is frequently located adjacent to a lamp at the mounting position owing to downsizing of luminaire or the like in recent years. In this instance, a sufficient space cannot be secured around the lamp, and accordingly it is difficult to rotate the lamp by hand.

On account of this, Japanese Patent Application Publication Number 2005-294239 published on Oct. 20, 2005 (hereinafter referred to as a "Patent Document 1") discloses a lamp socket by which a lamp can be rotated even if it is not grasped. As shown in FIG. 1, the lamp socket 1 of the Patent Document 1 has an operational arm 600*a* unified with a rotator 600. This operational arm 600*a* is formed to stick out from a cylindrical side of a socket case 610. In this lamp socket, by moving the operational arm 600*a* to rotate the rotator 600, a lamp rotates together with a rotary slit 620 of the rotator 600. That is, a lamp can be rotated even if it is not grasped.

By the way, in the lamp socket 1 of FIG. 1, a lamp is rotated around the axis of the lamp tube when the lamp is attached or detached. Therefore, the two lamp sockets 1 can be used for a straight tube fluorescent lamp having a straight lamp tube and two bases fixed to both ends of the lamp tube. However, the lamp socket 1 cannot be used for a lamp having a non-straight lamp tube and two bases fixed to both ends of the lamp tube.

DISCLOSURE OF THE INVENTION

It is an object of the present invention to attach or detach a lamp to or from a mounting position of luminaire without rotation of the lamp A present invention is a lamp socket for defining a mounting position of a lamp to luminaire and fixing the lamp placed at the mounting position. The lamp has lamp pins for power supply, which project from a base. The lamp socket comprises a mover and a supporter. The mover has therein contacts which can be electrically connected with the lamp pins, respectively. In a first aspect of the present invention, the supporter supports the mover so that the mover can be moved between predetermined open and close positions. If the mover is at the open position, the supporter supports the mover so that the mover does not prevent the lamp from being moved to or from the mounting position along a specified direction. The specified direction is a direction intersecting with the projection direction of the lamp pins when the lamp is at the mounting position. If the mover is at the open position and the lamp is in a posture by which it can be moved from the mounting position along the specified direction, the supporter supports the mover so that the contacts do not make contact with the lamp pins, respectively. If the mover is at the close position, the supporter supports the mover so that the mover prevents the lamp from being moved from or to the mounting position along the specified direction. If the mover is at the close position and a posture of the lamp is the same as said posture of the open position, the supporter supports the mover so that the contacts make contact with the lamp pins, respectively.

In this structure, when the mover is at the open position, a lamp can be moved and placed to the mounting position along the specified direction. In this condition, if the mover is moved to the close position, the mover prevents the lamp from being moved from the mounting position along the specified direction. The contacts also make contact with the lamp pins, respectively. On the other hand, if the mover is moved to the open position, the contacts do not make contact with the lamp pins, respectively. The lamp can be also moved from the mounting position along the specified direction. Therefore, if luminaire comprises a lamp socket of the present invention, the lamp can be attached to or detached from the mounting position of the luminaire without being rotated. Thus, a lamp doesn't need to be rotated at the mounting position of the luminaire, and accordingly a lamp socket of the present invention can be also used for a lamp comprising a non-straight lamp tube and two bases fixed to both ends of the lamp tube.

In a second aspect of the present invention, the lamp has two lamp pins as said lamp pins. The mover comprises two contacts as said contacts and a hollow inner body. The two contacts are put in the inner body to be arranged opposite to each other. The inner body is formed into a shape having a rotation axis. The inner body is formed with an operational lever and a lead-in mouth for inserting the two lamp pins between the two contacts. The supporter comprises a cylindrical surface and a facing surface and supports the inner body so that the inner body can be rotated around the rotation axis inside the cylindrical surface. The cylindrical surface has an opening from which the operational lever is projected. The facing surface faces the end face of the base when the lamp is placed at the mounting position. The facing surface is formed with a guide slit which is in shape of a straight line and joined to the opening of the cylindrical surface. The guide slit has the depth longer than the interval of the lamp pins and the width narrower than the interval. The specified direction corresponds to the direction passing through the top and the bottom of the guide slit when the mover is at the open position. The direction from the lead-in mouth to the space between the contacts corresponds to the depth direction of the guide slit when the mover is at the open position. The direction from the lead-in mouth to the space between the contacts also intersects with the depth direction when the mover is at the close position.

In this structure, the operational lever is projected from the opening of the cylindrical surface and the guide slit is joined to the opening, and accordingly the movement range of the operational lever can be narrowed and the lamp socket can be downsized. The luminaire comprising a lamp socket of the present invention can be also downsized.

In an embodiment of the invention in the second aspect, the opening of the cylindrical surface restricts the rotation range of the operational lever to the range between the open and close positions. In this structure, the operational lever can be easily stopped at an open or close position, because the rotation range of the operational lever is restricted through the opening of the cylindrical surface. Accordingly, working property when a lamp is attached or detached is improved.

In an embodiment of the invention in the second aspect, the mover comprises two insertion holes pierced in the inner body in the direction of the rotation axis. The two contacts are electrically connected to two conductors of electric wires, inserted into the two insertion holes, respectively. In this structure, the two conductors are electrically connected with the two contacts through the two insertion holes, respectively. Therefore, extra space is not required to be provided around the electric wires because it is possible to comparatively reduce a passage region of an electric wire in the lamp socket.

In a third aspect of the present invention, the lamp has two lamp pins as said lamp pins. The mover comprises two contacts as said contacts and a hollow inner body. The two contacts are put in the inner body to be arranged opposite to each other. The inner body is formed into a shape having a rotation axis. The inner body is formed with an operational lever and a lead-in mouth for inserting the two lamp pins between the two contacts. The supporter comprises a cylindrical surface and a facing surface and supports the inner body so that the inner body can rotate around the rotation axis inside the cylindrical surface. The cylindrical surface has an opening from which the operational lever is projected. The facing surface faces the end face of the base when the lamp is placed at the mounting position. The facing surface is formed with a guide opening joined to the opening of the cylindrical surface. The guide opening has the depth longer than the interval of the lamp pins. The specified direction corresponds to the direction passing through the top and the bottom of the guide opening when the mover is at the open position. The direction from the lead-in mouth to the space between the contacts corresponds to the depth direction of the guide opening when the mover is at the open position. The direction from the lead-in mouth to the space between the contacts also intersects with the depth direction when the mover is at the close position. The guide opening comprises a recess cut where the two lamp pins enter when the lamp placed at the mounting position is rotated in the movement direction of the mover.

In this structure, when the mover is at the open position, even if a user moves and places a lamp at the mounting position along the specified direction and then rotates the lamp in the movement direction of the mover by mistake, two lamp pins of the lamp enter the recess cut. Accordingly, a large load can be prevented from being added to the lamp pins and the lamp socket, because the lamp pins are not pressed against the lamp socket. Thereby, breakage of the lamp pins and lamp socket can be prevented.

In an embodiment of the invention in the third aspect, the guide opening has two recess cuts as said recess cut. The two recess cuts are formed so that the lamp placed at the mounting position can be rotated by substantially 90 degrees in the movement direction of the mover. In this structure, dimensions of the two recess cuts can be reduced in comparison with two recess cuts formed so that a lamp can be rotated over substantially 90 degrees in the movement direction of the mover. Accordingly, the mover having the two contacts can be put in the supporter formed with the guide opening including the small recess cuts. The lamp can be also rotated by substantially 90 degrees in the movement direction of the mover, and accordingly a user can notice an error operation or recognize that the lamp has been rotated sufficiently. Therefore, it is possible to obtain performance almost equal to the two recess cuts formed so that a lamp can be rotated over substantially 90 degrees. For example, advantage of breakage prevention of the lamp pins or the lamp socket can be obtained.

In an embodiment of the invention in the third aspect, the guide opening further comprises a guide cut joined to first recess cut of first and second cuts as said two recess cuts. The guide cut is formed so that the lamp pin in the first cut enters the guide cut from the first cut while guiding the lamp pin in the second cut to the top side of the guide opening, when the lamp is rotated over substantially 90 degrees. In this structure, breakage of the lamp pins or the lamp socket can be preferably prevented in comparison with the above structure in which a lamp can be rotated by substantially 90 degrees in the movement direction of the mover. Moreover, the guide opening is only provided with the guide cut, and accordingly area increase of the guide opening can be restrained.

Luminaire of the present invention comprises a lamp socket of the present invention. In the luminaire, it is possible to attach or detach a lamp to or from a mounting position of luminaire without rotation of the lamp. Therefore, the luminaire can be also used for a lamp comprising a non-straight lamp tube and two bases fixed to both ends of the lamp tube.

BRIEF DESCRIPTION OF THE DRAWINGS

Preferred embodiments of the invention will now be described in further details. Other features and advantages of the present invention will become better understood with regard to the following detailed description and accompanying drawings where:

FIG. 5A shows the lamp socket when a mover is at open position; and FIG. 5B shows the lamp socket when the mover is at close position;

FIG. 6A shows the operation of the lamp socket when the mover is at the open position; FIG. 6B shows the operation of the lamp socket when the mover is at the middle of the open and close positions; and FIG. 6C shows the operation of the lamp socket when the mover is at the close position;

FIG. 7A shows the lamp socket when the mover is at the open position; and FIG. 7B shows the lamp socket when the mover is at the close position;

FIG. 8A shows the luminaire from which a lamp is detached; and FIG. 8B shows the luminaire to which the lamp is attached;

BEST MODE FOR CARRYING OUT THE INVENTION

Figure 2:
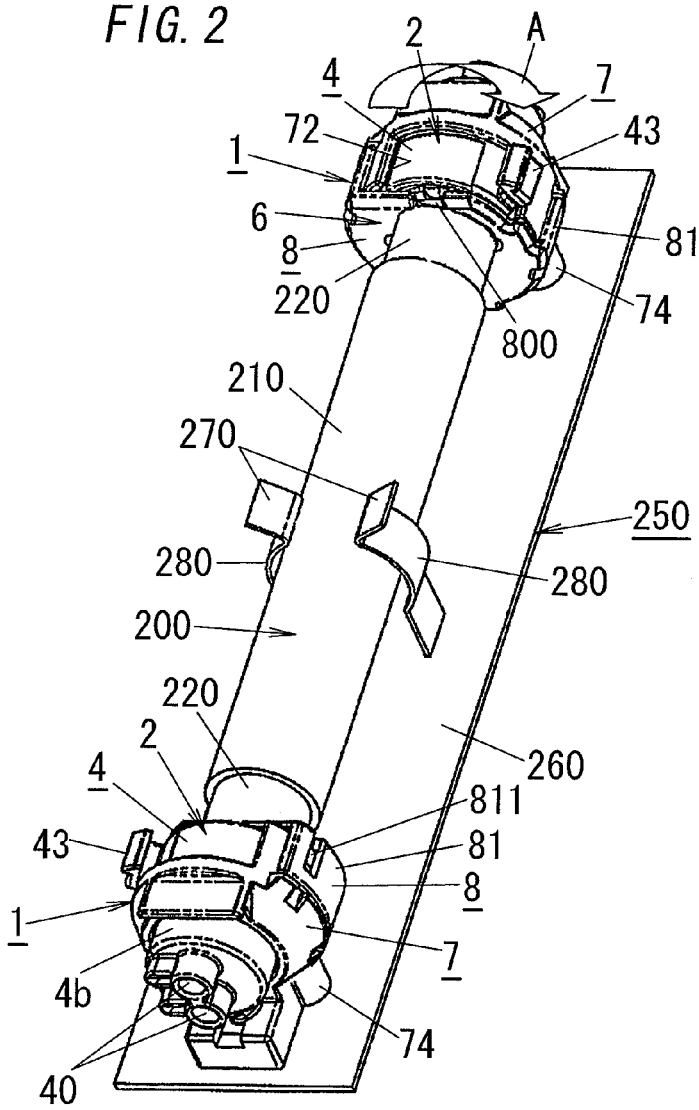
FIG. 2 is a perspective view of luminaire having lamp sockets, in accordance with a first embodiment of the present invention.

FIG. 2 shows two lamp sockets 1 in accordance with a first embodiment of the present invention. Each lamp socket 1 is fixed at a given position of a body 260 of luminaire 250 in order to attach a lamp 200 to a mounting position (place) of the luminaire 250. That is, the lamp sockets 1 are used to define the mounting position of the lamp 200 on the luminaire 250 and to fix the lamp 200 placed at the mounting position. In the example of FIG. 2, the body 260 is in the shape of a rectangular plate, and the two lamp sockets 1 are fixed at both ends of the body 260 in the length direction. The body 260 is also provided with a ballast (not shown). On the other hands, the lamp 200 is a straight tube fluorescent lamp, and each end of the lamp tube is provided with a base 220 from which two lamp pins for power supply (see 230 in FIG. 8A) are projected in the length (axis) direction of the lamp 200.

Figure 3:
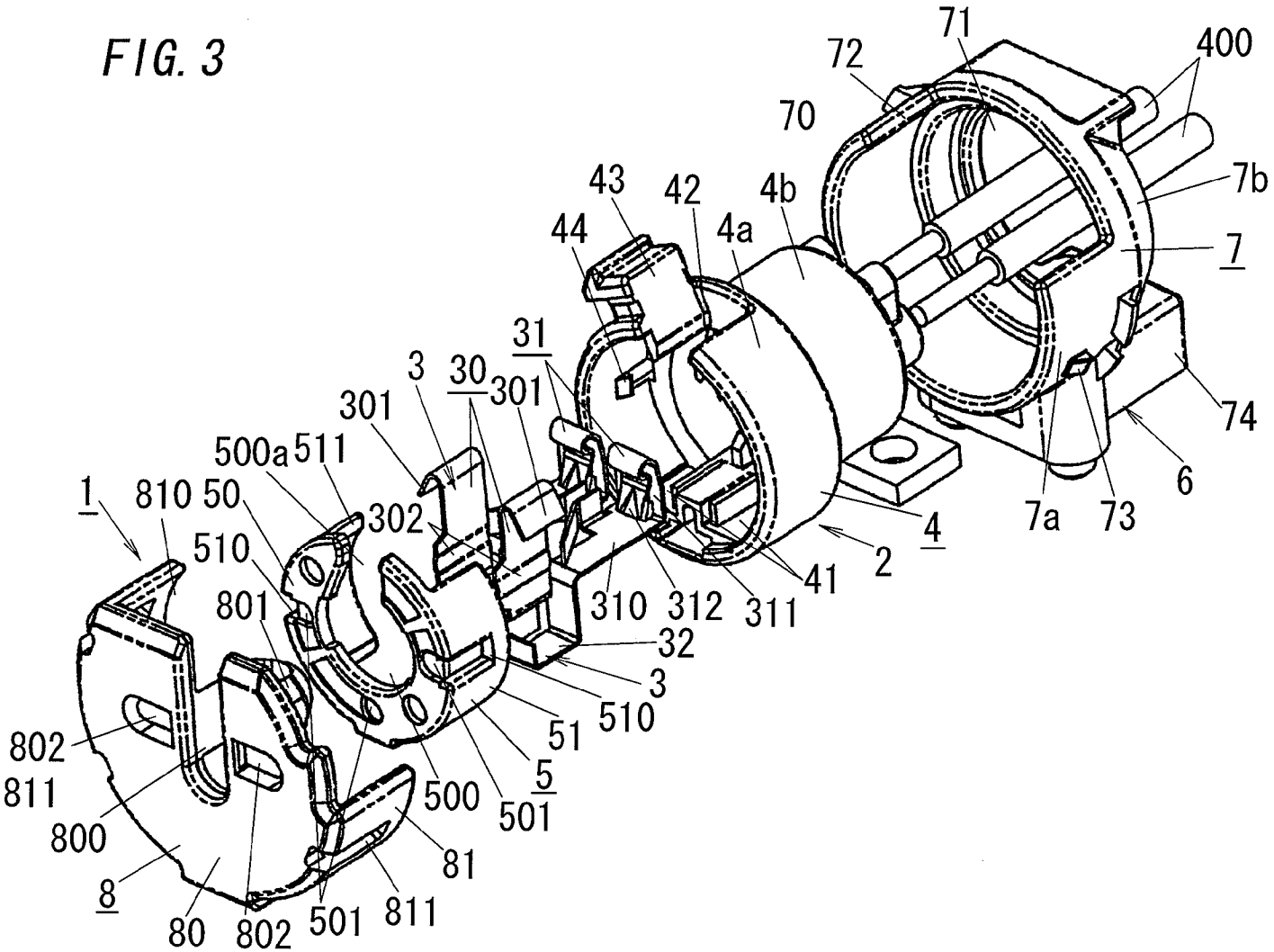
FIG. 3 is an exploded perspective view of a lamp socket in FIG. 2.
Figure 4:
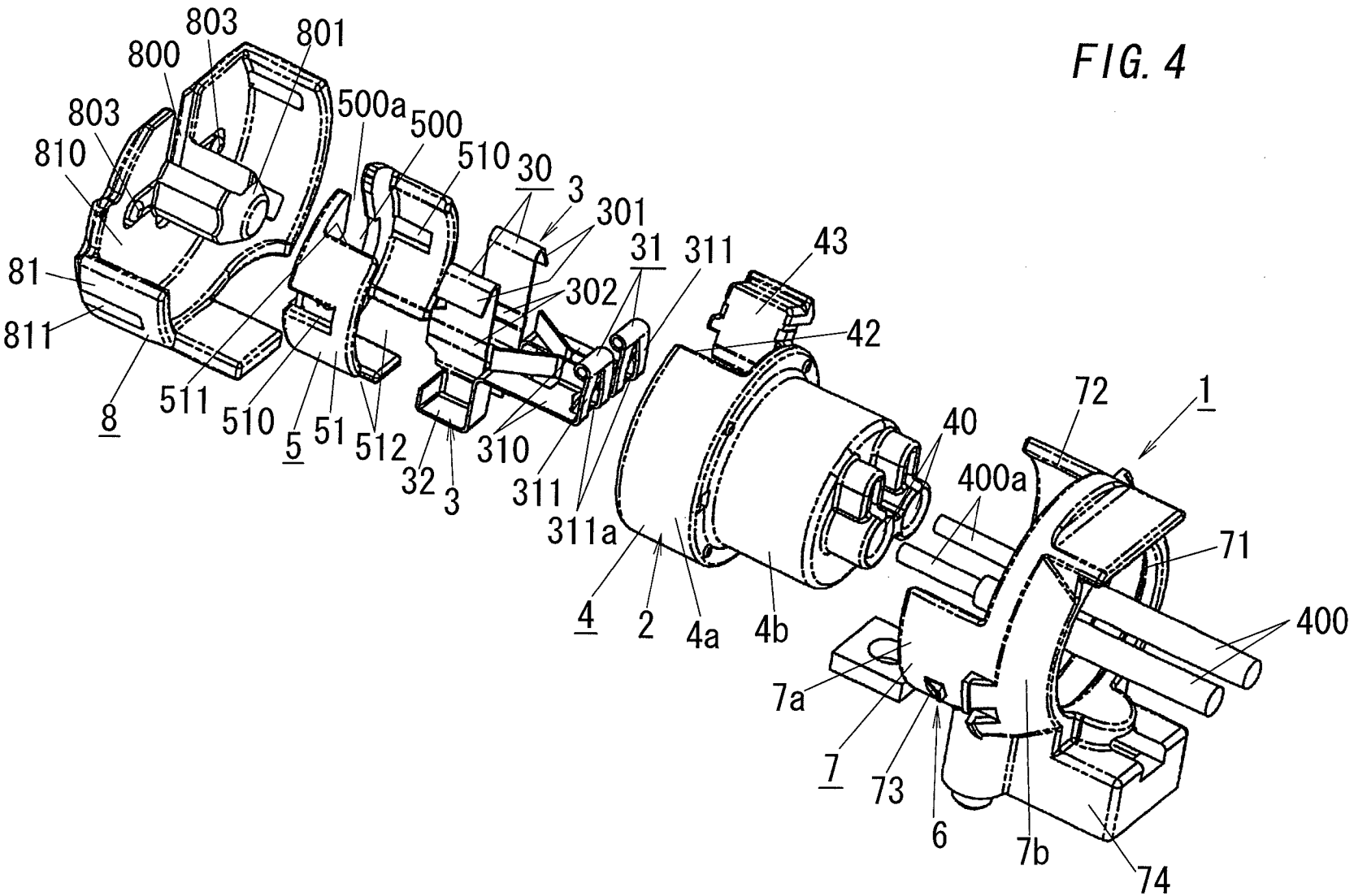
FIG. 4 is an exploded perspective view of a lamp socket in FIG. 2.

As shown in FIGS. 3 and 4, the lamp socket 1 is formed of a mover 2 and a supporter 6. The mover 2 has two contacts 30. The two contacts 30 can be in touch with and electrically connected with two lamp pins 230 of a corresponding base 220 of the lamp 200, respectively. The supporter 6 supports the mover 2 so that the mover 2 can be moved between predetermined open and close positions.

The mover 2 is formed of two conductive plates 3, an inner body 4 and an inner cover 5. Each conductive plate 3 is formed with a contact 30, a terminal 31 and a coupling piece 32. The terminal 31 can be electrically connected with an electric wire 400 for power supply to the lamp 200 and mechanically hold the electric wire 400. The coupling piece 32 couples the contact 30 and terminal 31 continuously and electrically. The inner body 4 is, for example, a synthetic resin molding made of resin material for insulation, and is in the shape of a cylinder that has an opening and a bottom. The inner cover 5 is attached to the opening side of the inner body 4 so that the two conductive plates 3 are put between the inner body 4 and the inner cover 5. The mover 2 includes two insertion holes 40 pierced in the bottom of the inner body 4 in the axis (rotation axis) direction of the inner body 4. Thereby, the two contacts 30 are electrically connected to two conductors 400*a* of the electric wires 400 inserted into the two insertion holes 40, respectively.

The terminal 31 is formed of a connection piece 310, a conductor inserted piece 311 and a lock piece 312. The connection piece 310 is extended from the rear end of the coupling piece 32 in the insertion direction of the conductor 400*a* of the electric wire 400. The conductor inserted piece 311 is extended from the tip of the connection piece 310 to be bent at right angle, and has a hole 311*a* to which the conductor 400*a* is inserted. The lock piece 312 is extended from the tip of the conductor inserted piece 311 to the connection piece 310, and fixes the conductor 400*a* in cooperation with the connection piece 310. That is, the terminal 31 is what is called a quick terminal, and pinches the conductor 400*a* inserted into the hole 311*a* between the connection piece 310 and the tip edge of the lock piece 312. Thereby, the terminal 31 is electrically connected with an electric wire 400 while holding the electric wire 400 mechanically at the same time.

The contact 30 is extended from the front end of the coupling piece 32. The two contacts 30 are arranged opposite to each other at the opening side of the inner body 4 when the two conductive plates 3 are put in the inner body 4. Specifically, the two terminals 31 are put in the inner body 4 so that the two conductor inserted pieces 311 face the two insertion holes 40, respectively. At this point, the two conductive plates 3 are incorporated into the inner body 4 so that the interval of the contacts 30 is larger than each diameter of lamp pins 230 and narrower than the interval of the two lamp pins 230. On account of this, each coupling piece 32 is formed into square C-shape in longitudinal section, and the inner body 4 is formed therein with two fixing grooves 41 for positioning the two coupling pieces 32. In the example of FIG. 3, the two coupling pieces 32 are fit into the two fixing grooves 41, respectively and thereby the two coupling pieces 32, namely the two conductive plates 3 are positioned. The two contacts 30 are formed with two hooks 301 turned back in the direction apart from each other, respectively. The two hooks 301 are hung to parts of the inner cover 5, and thereby the two contacts 30 are attached inside the mover 2. Each contact 30 is also formed with a concave pin holder 302 at the center in the length direction of the contact 30. When the two conductive plates 3 are put in the inner body 4, the two pin holders 302 are arranged opposite to each other. Therefore, two lamp pins 230 are inserted between the two contacts 30 to be fit into the two pin holders 302, respectively and thereby the lamp pins 230 are respectively connected with the contacts 30 mechanically and electrically.

The inner body 4 can be divided into a larger-diameter part 4*a* and a smaller-diameter part 4*b*. The larger-diameter part 4*a* is formed so as to be larger in diameter than the smaller-diameter part 4*b*. The larger-diameter part 4*a* and smaller-diameter part 4*b* are arranged at the opening and bottom sides of the inner body 4, respectively. The contacts 30 and coupling pieces 32 are put in the larger-diameter part 4*a*, and the terminals 31 are put in the smaller-diameter part 4*b*. The larger-diameter part 4*a* is formed with a lead-in mouth 42 and an operational lever 43. The lead-in mouth 42 is formed at the sides of the hooks 301 of the two contacts 30 so that the space between the contacts 30 is opened through the lead-in mouth 42. The operational lever 43 is located adjacent to the lead-in mouth 42 in the circumferential direction of the larger-diameter part 4*a*, and is projected in a radius direction of the larger-diameter part 4*a*. The function of this operational lever 43 will be discussed later.

The inner cover 5 has a horseshoe-shaped front wall 50 and a U-shaped side 51. The front wall 50 is formed with a pin inserted hole 500 which is in the shape of a bulb. The side 51 is extended backward from the outer edge of the front wall 50. The side 51 is formed with a cut 511 joined to an opening 500*a* of the pin insertion hole 500, and two cuts 512 corresponding to the two coupling pieces 32, respectively. The side 51 is inserted into the larger-diameter part 4*a* of the inner body 4 and thereby the inner cover 5 is combined with the inner body 4. At this point, two engaging nails 44 projected from the inner face of the larger-diameter part 4*a* are engaged with two engaging holes 510 pierced in the side 51, respectively. Consequently, the inner cover 5 is coupled to the inner body 4 and the two conductive plates 3 are fixed inside the inner body 4 and inner cover 5. The hooks 301 of the two contacts 30 are also hung to both edges of the cut 511 of the side 51, respectively. Thus, when the inner cover 5 is coupled to the inner body 4, the opening 500*a* of the pin insertion hole 500 is connected with the lead-in mouth 42 of the inner body 4 and the base (circular part) of the pin insertion hole 500 is put in front of the two contacts 30. The diameter of the base is set to be larger than the interval of two lamp pins 230 projected from a base 220.

The supporter 6 is formed of an outer body 7 and an outer cover 8, each of which is a synthetic resin molding made of resin material for insulation. The resin material of the outer body 7 especially has a good sliding performance with respect to the resin material of the inner body 4. The outer body 7 is, for example, in the shape of a cylinder that has a larger-diameter opening 70 and a smaller-diameter opening 71 corresponding to the larger-diameter part 4*a* and smaller-diameter part 4*b*, respectively. The outer cover 8 is attached to the side of the larger-diameter opening 70 of the outer body 7 so that the mover 2 can be rotated between the outer body 7 and outer cover 8.

The outer body 7 can be divided into a slide part 7*a* and an insertion part 7*b*. The slide part 7*a* is formed with an operational window 72 having a predetermined angle. The insertion part 7*b* has a taper surface that becomes gradually narrower towards the back. The slide part 7*a* is set to be larger in diameter than the insertion part 7*b*. That is, the inner diameter of the slide part 7*a* is set to be almost the same as the outer diameter of the larger-diameter part 4*a* of the mover 2. The smaller-diameter opening 71 of the insertion part 7*b* is set to be almost the same as the outer diameter of the smaller-diameter part 4*b*. Herein, the larger-diameter part 4*a* is put in the slide part 7*a* so that the operational lever 43 can move inside the operational window 72. On the other hands, the smaller-diameter part 4*b* is inserted into the insertion part 7*b*. In short, when the mover 2 is incorporated into the outer body 7, the larger-diameter part 4*a* of the mover 2 is fit into the slide part 7*a* and the rear of the smaller-diameter part 4*b* is projected outward from the smaller-diameter opening 71.

The outer cover 8 has a front wall 80 and a U-shaped side 81. The front wall 80 includes a facing surface with respect to the end face of a base 220. The side 81 is extended backward from the outer edge of the front wall 80, and is formed with a cut 810. The slide part 7*a* of the outer body 7 is inserted into the side 81 and thereby the outer cover 8 is combined with the outer body 7. At this point, three engaging nails 73 projected from the outer surface of the slide part 7*a* are engaged with three engaging holes 811 pierced in the side 81, respectively. Consequently, the outer cover 8 is coupled to the outer body 7 so that the mover 2 can be rotated between the outer body 7 and outer cover 8. Herein, the supporter 6 has a cylindrical surface formed of the slide part 7*a* and side 81, and the cylindrical surface corresponds to the cylindrical surface of the supporter of the present invention. The supporter 6 also has an opening formed of the operational window 72 and cut 810, and the opening corresponds to the opening of the cylindrical surface of the present invention. In the first embodiment, the cut 810 is set to be larger than the operational window 72 in the circumferential direction. The front wall 80 of the outer cover 8 is formed with a straight-line-shaped guide slit 800 joined to the opening of the cylindrical surface, namely the cut 810 and operational window 72. The depth of the guide slit 800 is set to the dimension longer than the interval of two lamp pins 230 so that the two lamp pins 230 can be inserted into the guide slit 800. The width of the guide slit 800 is also set to the dimension that is narrower than the interval of two lamp pins 230 and little bit larger than each diameter of lamp pins 230.

The rear of the front wall 50 is formed with a U-shaped axis 801 projected backward from the center. That is, the axis 801 has a through slit joined to the guide slit 800. This through slit is set to the dimension longer than any length of the two lamp pins 230 inserted into the guide slit 800. The outer diameter of the axis 801 is also set to the dimension shorter than the interval of the two lamp pins 230. Accordingly, the axis 801 comes to exist between the two lamp pins 230 inserted into the guide slit 800. When the mover 2 is incorporated into the supporter 6, the axis 801 is inserted into the mover 2 through the pin insertion hole 500 to be intervened between the two contacts 30.

The lamp socket 1 is formed by putting the mover 2 in the supporter 6. As shown in FIG. 2, the outer body 7 of the supporter 6 includes a base 74 that is fixed to the body 260 of the luminaire 250 by using, for example, screws. In the example of FIG. 2, the two lamp sockets 1 are fixed to the body 260 so that the front walls 80 of the outer covers 8 are arranged opposite to each other. The lamp 200 is attached to the two lamp sockets 1 so that the end faces of the two bases 220 face the two the front walls 80, respectively.

In the lamp socket 1, the mover 2 is supported by the supporter 6 so that the mover 2 can be rotated around the axis 801. The rotation range of the mover 2 is restricted to the dimension (said predetermined angle) of the operational window 72 of the outer body 7. That is, the operational lever 43 of the mover 2 projects from the operational window 72, and accordingly can be rotated within the rotation range that the operational lever 43 touches the opening edge of the operational window 72. In short, the common rotation range of the operational lever 43 and mover 2 is restricted to the dimension of the operational window 72 (the opening formed of the cut 810 and operational window 72).

Figure 5A:
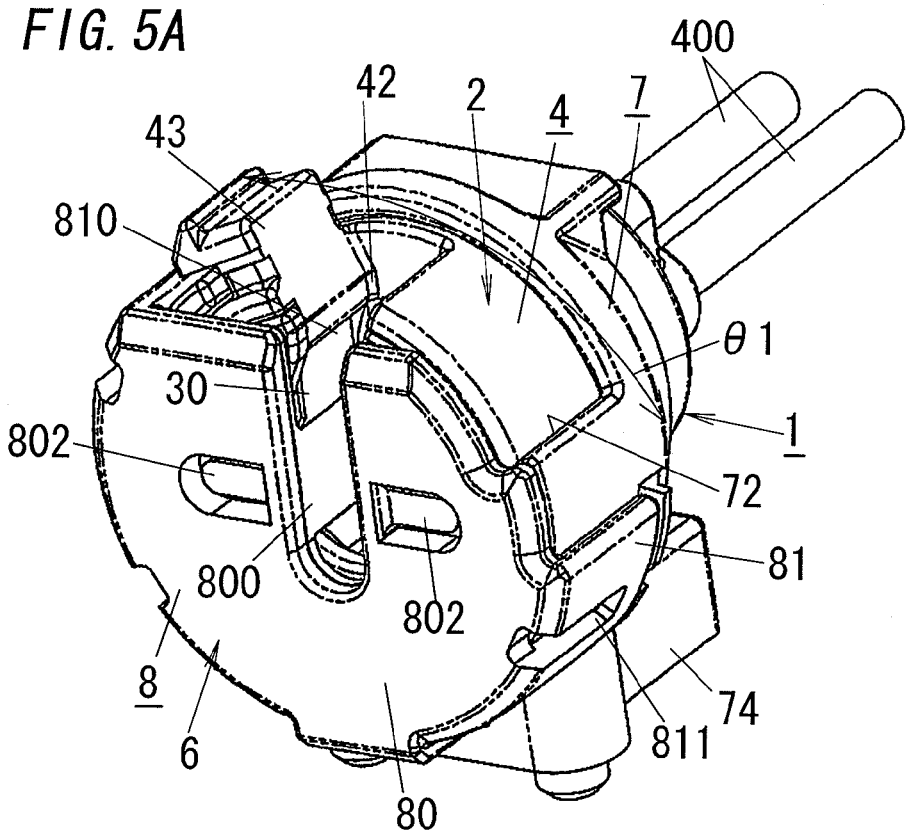
FIGS. 5A and 5B illustrate a lamp socket in FIG. 2; particularly.
Figure 5B:
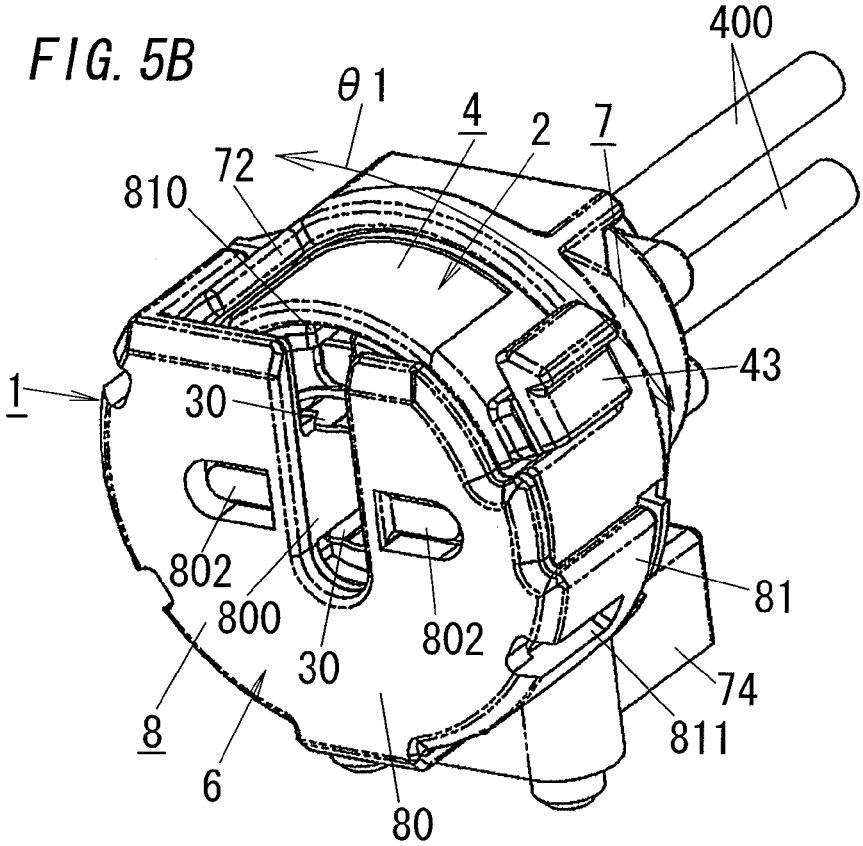

The rotation range (θ1) of the mover 2 is restricted between the position shown in FIG. 5A and the position shown in FIG. 5B. The position shown in FIG. 5A is referred to as an "open position", and the position shown in FIG. 5B is referred to as a "close position". When the mover 2 (operational lever 43) is at the open position, the direction from the lead-in mouth 42 to the space between the contacts 30 corresponds to the depth direction of the guide slit 800. In this instance, the lead-in mouth 42 is connected with the guide slit 800. When the mover 2 is at the close position, the direction from the lead-in mouth 42 to the space between the contacts 30 intersects with the depth direction of the guide slit 800. In this instance, the lead-in mouth 42 is disengaged from the opening (top) of the guide slit 800 and is blocked off with the cylindrical surface of the supporter 6 (the slide part 7*a* of the outer body 7). In the first embodiment, the close position is the position of the mover 2 which when is rotated clockwise by substantially 90 degrees from the open position. Also, the direction passing through the top and bottom of the guide slit 800 corresponds to the specified direction of the present invention.

Specifically, when the mover 2 is at the open position, the lead-in mouth 42 overlaps the guide slit 800 and also the pin insertion hole 500 of the mover 2 is opened laterally through the lead-in mouth 42, operational window 72 and cut 810. Accordingly, two lamp pins 230 can be inserted into the pin insertion hole 500 from the side of the lead-in mouth 42 along the guide slit 800, and the lamp 200 can be placed at the mounting position of the luminaire 250. Conversely, two lamp pins 230 can be pulled out of the pin insertion hole 500 through the side of the lead-in mouth 42 along the guide slit 800, and the lamp 200 can be removed from the mounting position. In these cases, the lamp is moved, for example, substantially in parallel with the plane including the mounting position of luminaire.

Figure 6A:
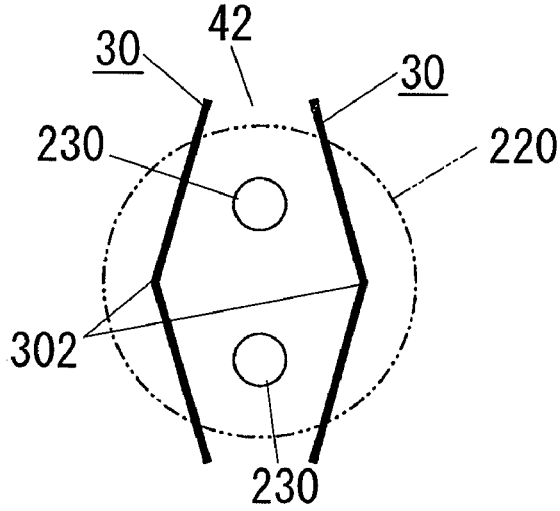
FIGS. 6A through 6C illustrate the operation of a lamp socket in FIG. 2; particularly.

As shown in FIG. 6A, when the mover 2 is at the open position, the direction from the lead-in mouth 42 to the space between the contacts 30 corresponds to the depth direction of the guide slit 800. At this point, the interval of the contacts 30 is larger than each diameter of lamp pins 230, and accordingly two lamp pins 230 inserted into the pin insertion hole 500 is not in contact with and electrically connected with the contacts 30.

Figure 6B:
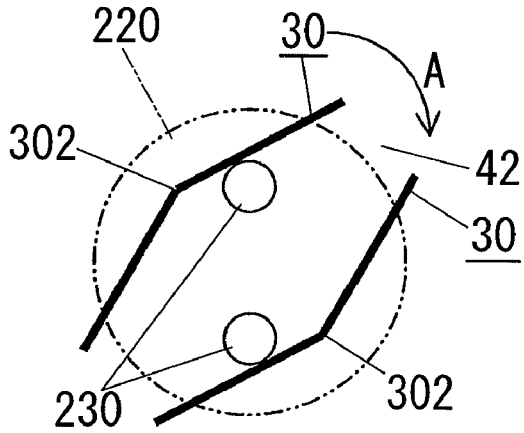
Figure 6C:
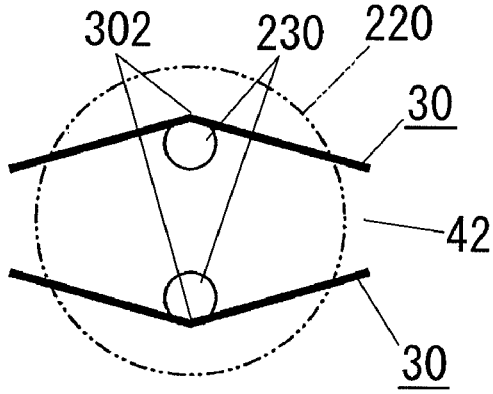

The mover 2 is then rotated clockwise (see the arrow A) from the position of FIG. 6A to the position of FIG. 6C via the position of FIG. 6B. When the mover 2 is at the close position, the lead-in mouth 42 is put away from the opening of the guide slit 800 and is blocked off with the cylindrical surface of the supporter 6 (the slide part 7*a* of the outer body 7). Accordingly, the two lamp pins 230 are blocked with the mover 2 and cannot be moved from and pulled out of the pin insertion hole 500 along the specified direction. Therefore, after a lamp 200 is placed at the mounting position of the luminaire 250, each mover 2 is moved at the close position and thereby the lamp 200 can be fixed to the mounting position (each lamp socket 1).

As shown in FIG. 6C, when the mover 2 is at the close position, the direction from the lead-in mouth 42 to the space between the contacts 30 intersects with the depth direction of the guide slit 800 at substantially 90 degrees. At this point, the interval of the contacts 30 is narrower than the interval of the two lamp pins 230, and accordingly the two lamp pins 230 inserted into the pin insertion hole 500 are in contact with and electrically connected with the contacts 30. The two lamp pins 230 are also fit in and held by the pin holders 302 of the two the contacts 30, respectively. Since a contact 30 is one part of a conductive plate 3, the contact pressure of the contact 30 against a lamp pin 230 is secured by the elasticity of the conductive plate 3.

In the first embodiment, when the lamp 200 is at the mounting position of the luminaire 250, each mover 2 is rotated and moved to the close position and thereby the lamp 200 can be fixed to the mounting position. Each mover 2 is also rotated and moved to the open position and thereby the lamp 200 can be removed from the mounting position. Herein, two pairs of lamp pins 230 exist in the guide slits 800 of the two supporters 6, respectively, and accordingly the lamp 200 is kept in a posture by which it can be moved from the mounting position along the specified direction, and is not rotated together with the mover 2.

Thus, the mover 2 is rotated as shown by the arrow A of FIG. 2 and thereby the lamp 200 can be fixed to the mounting position of the luminaire 250 without being rotated. Similarly, the mover 2 is rotated in the opposite direction of the arrow A and thereby the lamp 200 can be removed from the mounting position without being rotated. Therefore, since the lamp 200 doesn't need to be rotated, the lamp 200 can be easily attached to or detached from the mounting position even if a space for rotating the lamp 200 by hand can not be secured around the lamp 200. In conventional lamp sockets, a lamp needs to be rotated when the lamp is attached or detached, and accordingly, in a large lamp, working property when the lamp is attached or detached becomes worse. In the first embodiment, a lamp can be easily attached or detached only by moving the mover 2 regardless of the size of a lamp.

In the first embodiment, as shown in FIGS. 3 and 4, two bendable pieces 802 are formed of two U-slits and also located at both sides of the axis 801 in the front wall 80 of the outer cover 8, respectively. The tip sides of the two bendable pieces 802 are bendable, and two protuberances 803 are projected backward from the tips of the two bendable pieces 802, respectively. On the other hands, the front wall 50 of the inner cover 5 is formed with a plurality of holes 501. Each of the two protuberances 803 is fit in any of the holes 501. In the example of FIG. 3, the plurality of holes 501 include two holes 501 in which the protuberances 803 are fit respectively when the mover 2 is at the open position, and a hole 501 in which one of the protuberances 803 is fit when the mover 2 is at the close position. When the mover 2 exists at the close position, the other of the protuberances 803 is fit in the opening side of the pin insertion hole 500. However, not limited to this, the holes 501 may include two holes in which the protuberances 803 are fit respectively when the mover 2 is at the close position. Therefore, if the mover 2 is rotated from the open position, the two protuberances 803 are pushed out from the two holes 501 while bending the two bendable pieces 802, respectively. Subsequently, if the mover 2 is moved to the close position, the two protuberances 803 are fit in the hole 501 and the opening side of the pin insertion hole 500, respectively. At this point, click feel can be obtained. Similarly, click feel can be also obtained when the mover 2 is moved from the close position to the open position.

Figure 7A:
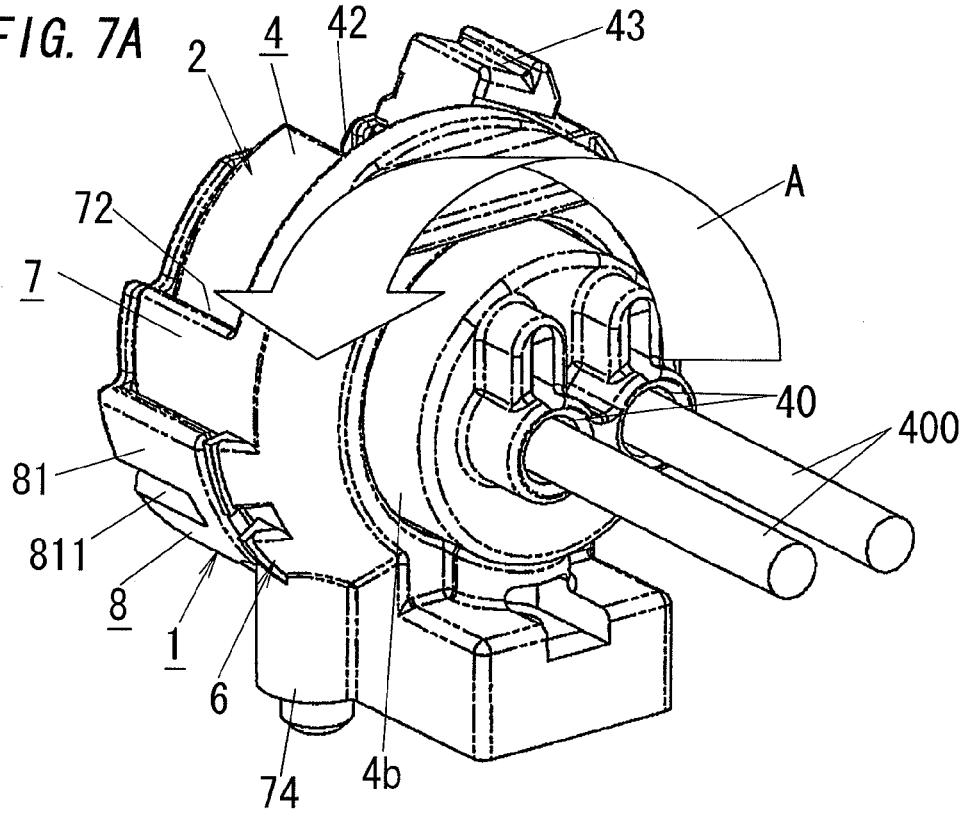
FIGS. 7A and 7B are perspective views of a lamp socket in FIG. 2 seen from the back side; particularly.
Figure 7B:
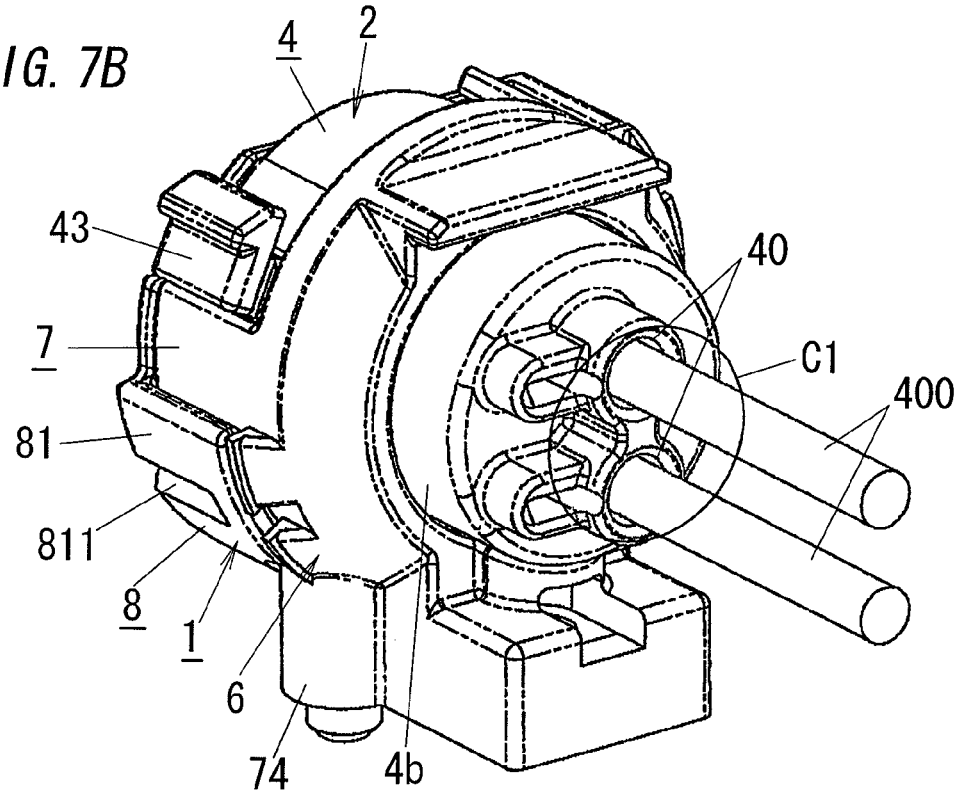

As shown in FIGS. 7A and 7B, the mover 2 includes two insertion holes 40 pierced in the bottom of the inner body 4 in the direction of the axis (rotation axis) of the inner body 4. In this instance, two conductors 400*a* of electric wires 400 (sheaths are not shown) are inserted into the two insertion holes 40 in the direction of the rotation axis of the mover 2, respectively. Accordingly, even if the mover 2 is rotated between the open position shown in FIG. 7A and the close position shown in FIG. 7B, as shown by the arrow A, the passage region C1 of the electric wires 400 into the mover 2 can be reduced comparatively. That is, extra space doesn't need to be secured around the two insertion holes 40 into which two conductors 400*a* of electric wires 400 are inserted.

As shown in FIG. 5A, the face of the lead-in mouth 42 side in the operational lever 43 is a flat surface continued with a part of the aperture plane of the lead-in mouth 42 in the inner body 4. Accordingly, when two lamp pins 230 are inserted into the pin insertion hole 500 from the side of the lead-in mouth 42 along the flat surface, the lamp pins 230 are guided by the flat surface. Therefore, the lamp pins 230 can be easily inserted into or pulled out of the pin insertion hole 500.

As shown in FIG. 2, the body 260 of the luminaire 250 is provided with a temporary holder 270 for temporally holding the lamp 200 at the mounting position. The temporary holder 270 includes, for example, two spring clamps each of which is formed of a plate material having elasticity. The temporary holder 270 pinches and temporally holds the center part of the lamp 200 at the mounting position regardless of a position (open and close positions) of the mover 2. The two spring clamps respectively have two arc-shaped concavities 280 facing to each other, each of which has a shape corresponding to the side of the lamp 200. When the mover 2 is at the open position, the lamp 200 can be removed by spreading the bent tips of the spring clamps. In an example, the temporary holder 270 may be unified with the supporter 6.

The temporary holder 270 is provided and thereby the lamp 200 at the mounting position can be temporally held regardless of a position of the mover 2. In this instance, a worker or a user only rotates the mover 2 with the operational lever 43 without rotating the lamp 200 by hand, and thereby the lamp 200 can be easily fixed (locked) or released. Moreover, when the lamp 200 is released, namely when the mover 2 is at the open position, the lamp pins 230 are not in contact with the contacts 30.

Figure 8A:
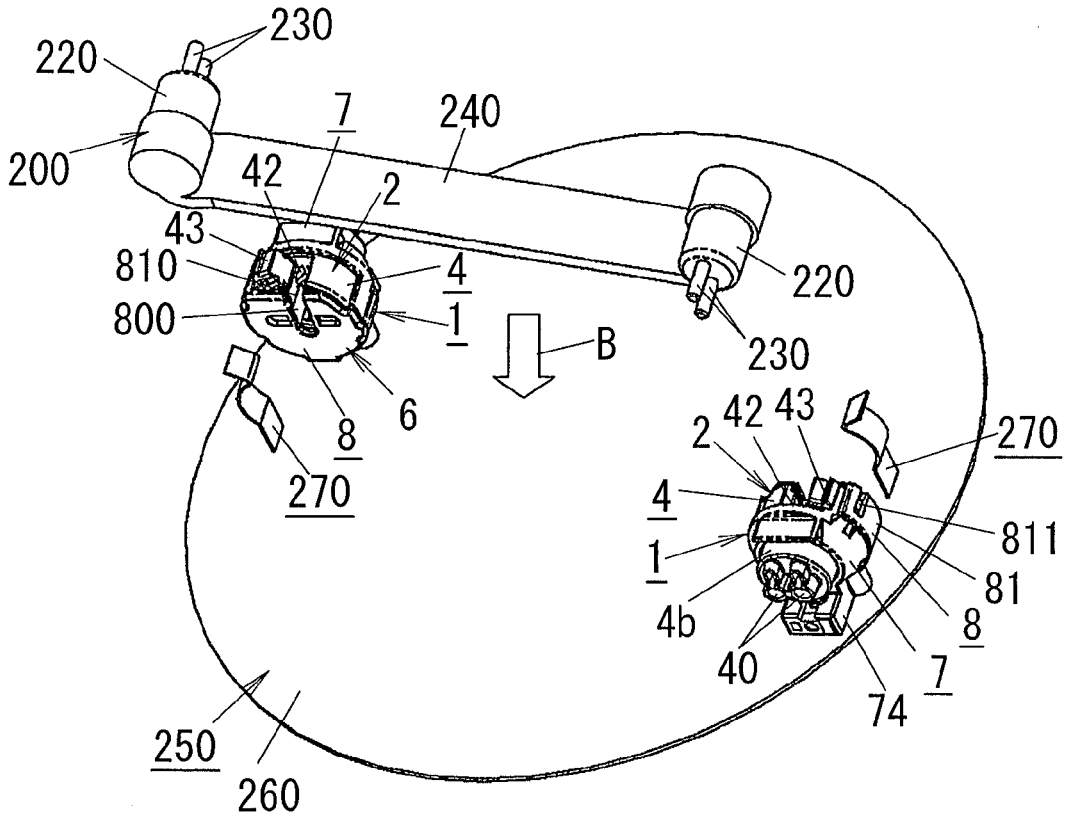
FIGS. 8A and 8B are perspective views of another luminaire having lamp sockets of the first embodiment; particularly.
Figure 8B:
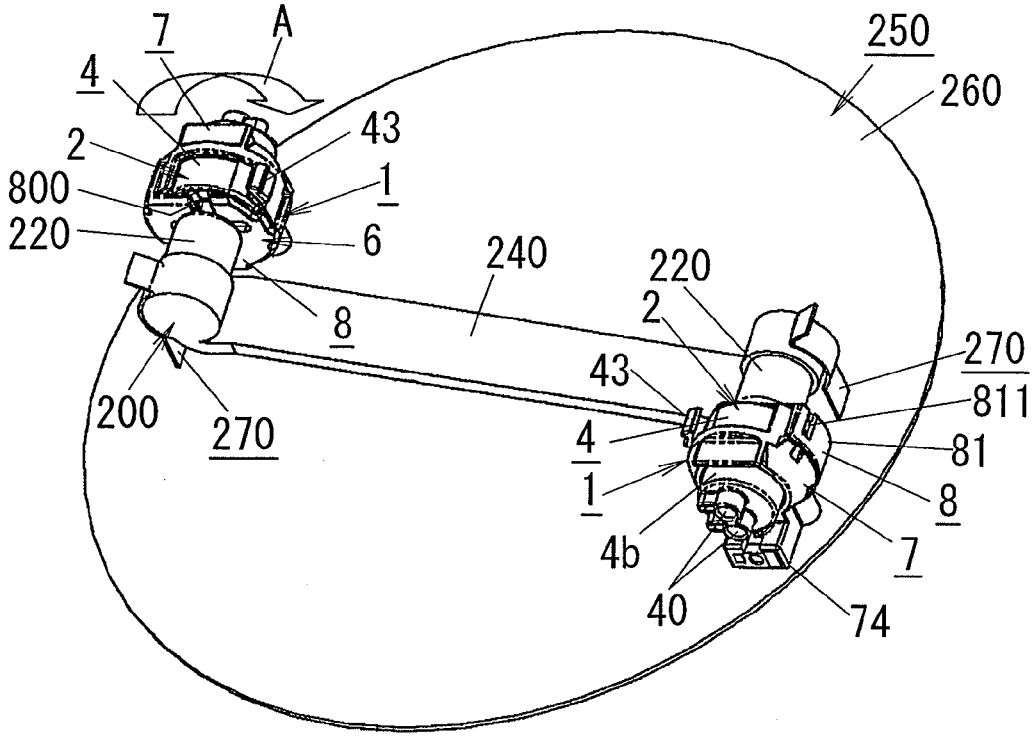

The lamp socket 1 in the first embodiment can be also applied to, for example, the luminaire 250 for a non-straight tube fluorescent lamp shown in FIGS. 8A and 8B, besides the luminaire 250 for a straight tube fluorescent lamp in FIG. 2. The lamp 200 of the luminaire 250 in FIGS. 8A and 8B has two bases 220, but each projection direction of two pairs of lamp pins 230 projected from the two bases 220 is not on the same straight line. That is, the two bases 220 are joined to both ends of a coupling piece 240 so that the two pairs of lamp pins 230 project in the opposite directions to each other. Therefore, the lamp tube (not shown) between the bases 220 becomes a non-straight tube. For example, the lamp tube may have a shape such that two parts extended from the two bases 220 are spirally bent in the counterclockwise direction (e.g., 1½ rotations) to be joined to each other at the middle of the coupling piece 240. The luminaire 250 of FIGS. 8A and 8B has a disc-shaped body 260, and the two lamp sockets are fixed to the body 260 based on the positions corresponding to the two bases 220.

Figure 1:
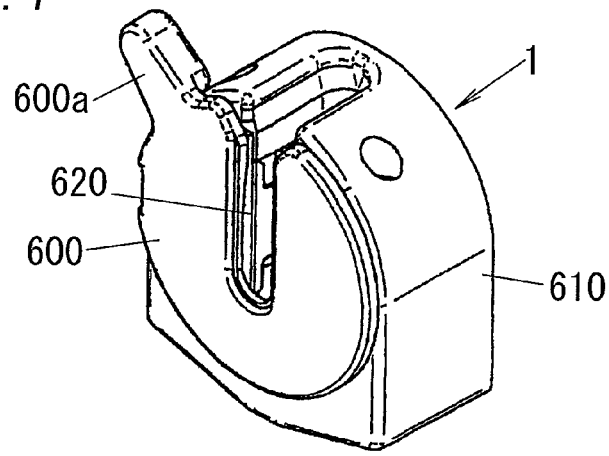
FIG. 1 is a perspective view of a conventional lamp socket.

In the lamp 200 of FIGS. 8A and 8B, since each projection direction of the two pairs of lamp pins 230 is not on the same straight line, the lamp 200 cannot be rotate around the center axis of the lamp tube like a straight tube fluorescent lamp. Because of this, in luminaire having lamp sockets of FIG. 1, the lamp 200 of FIGS. 8A and 8B cannot be employed. On the other hand, in luminaire having lamp sockets 1 of the first embodiment, the lamp 200 of FIGS. 8A and 8B doesn't need to be rotated and accordingly the lamp 200 can be employed. That is, as shown in FIG. 8A, when each mover 2 is at the open position, the lamp 200 is placed at the mounting position of the luminaire 250. At this point, the lamp 200 is moved as shown by the arrow B so that two pairs of lamp pins 230 in the lamp 200 are inserted into the pin insertion holes 500 of two lamp sockets 1, respectively. Each mover 2 is then moved to the close position as shown by the arrow A of FIG. 8A and thereby the lamp 200 is fixed to the mounting position and attachment and electrically connection of the lamp 200 are completed.

Thus, in the lamp socket 1 of the first embodiment, a lamp 200 can be attached and detached without being rotated. Therefore, even if each projection direction of two pairs of lamp pins 230 is not on the same straight line, the lamp can be attached to or detached from the mounting position of luminaire. Moreover, since a space for rotating a lamp is unnecessary, luminaire can be downsized.

The luminaire 250 of FIGS. 8A and 8B has a temporary holder 270 for temporally holding the lamp 200 by clamping the bases 220 fixed at both ends of the coupling piece 240. Thereby, the lamp 200 can be temporally held in the state that a load is not added to the lamp tube. Also, since a load is not added to the lamp tube, it is possible to employ a lamp 200 having a glass lamp tube of which strength is difficult to increase owing to a narrowed tube and a complicated shape.

In an embodiment, the outer cover 8 has a mechanism for preventing the conductive plates 3 from coming off the inner body 4. In this instance, the inner cover 5 can be left out. In an embodiment, the outer cover 8 is unified with the body 260 of luminaire 250. In another embodiment, the supporter 6 is formed of two members which can be separated in the longitudinal direction passing through the guide slit 800.

Figure 9:
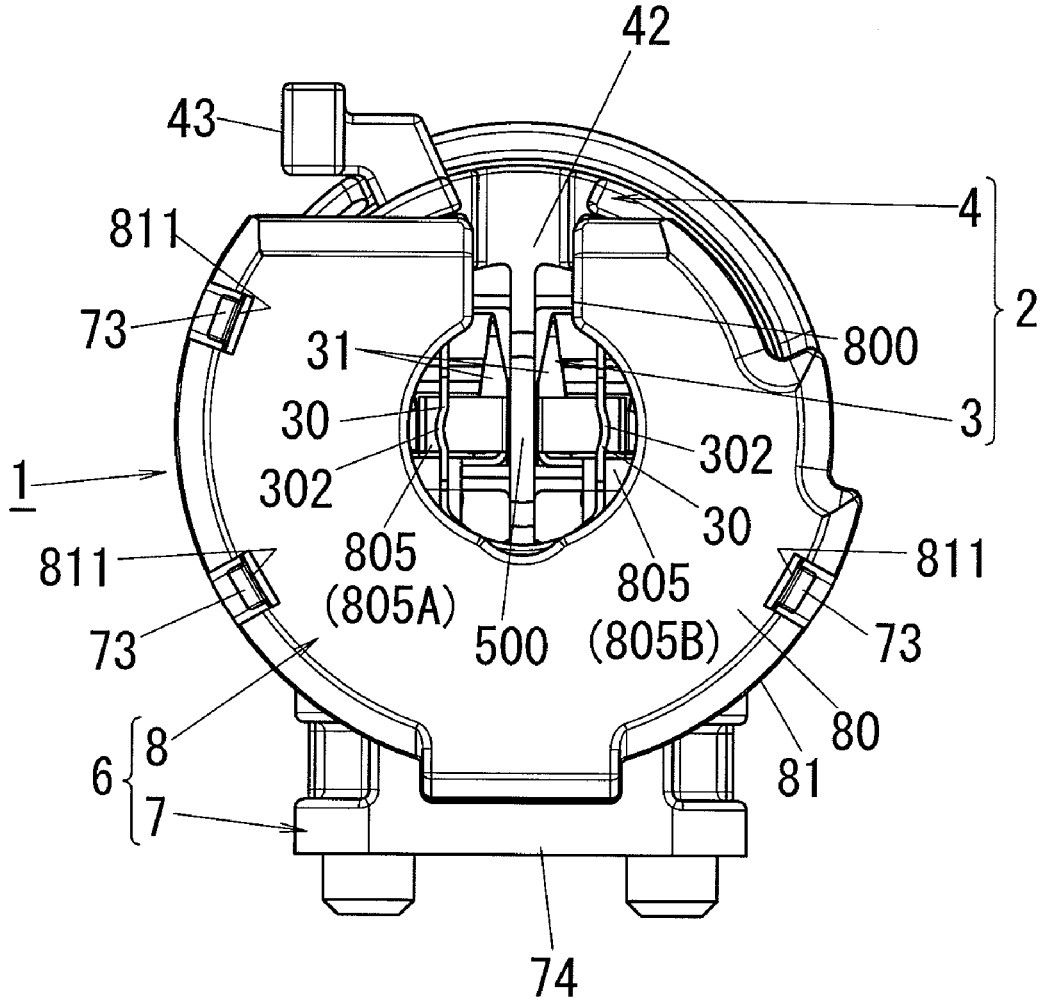
FIG. 9 is a front view of a lamp socket in accordance with a second embodiment of the present invention.

FIG. 9 shows a lamp socket 1 in accordance with a second embodiment of the present invention. This lamp socket 1 is formed to solve an issue of the lamp socket of the first embodiment.

Figure 10A:
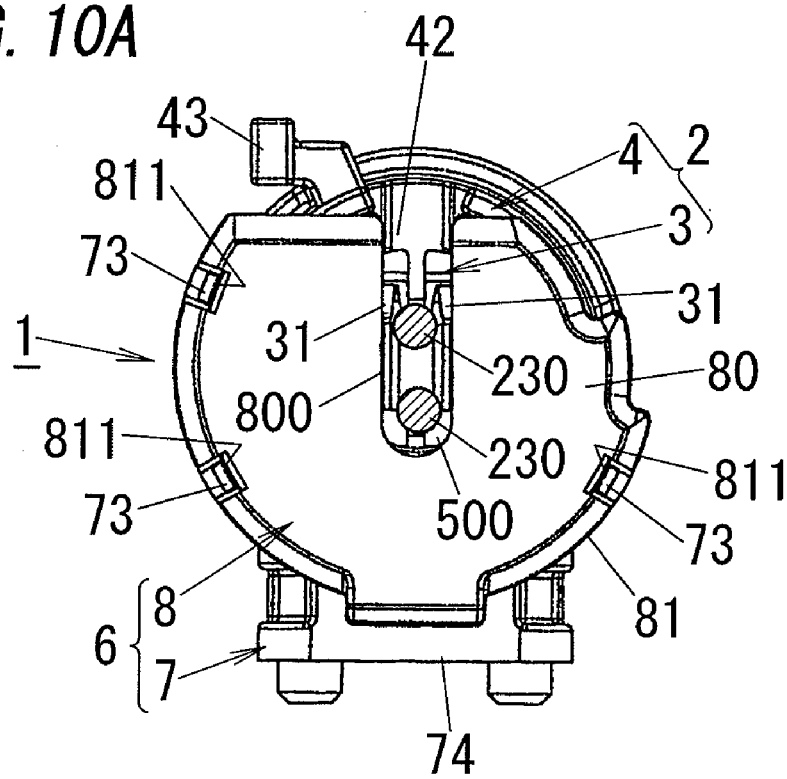
FIGS. 10A and 10B are explanatory diagrams of an issue of the lamp sockets in FIG. 2.
Figure 10B:
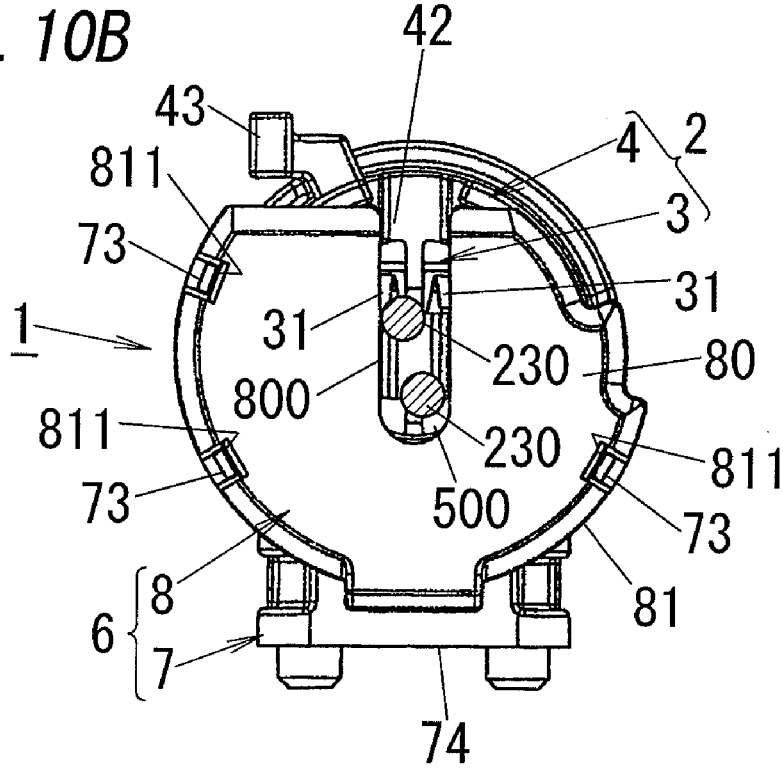

The issue is first explained. In luminaire having lamp sockets 1 of the first embodiment, the movers 2 of the lamp sockets 2 are rotated in the state that the lamp 200 is not rotated, and thereby a lamp 200 can be attached to the mounting position of the luminaire. Similarly, the lamp 200 can be removed from the mounting position. This attachment and detachment mechanism is completely different from the conventional mechanism by which a straight tube fluorescent lamp is rotated and thereby can be attached to or detached from the mounting position of luminaire. Accordingly, in the first embodiment, after a lamp (a straight tube fluorescent lamp) is placed at the mounting position of luminaire as shown in FIG. 10A, an error operation to try to rotate the lamp as shown in FIG. 10B may be performed.

For example, if a user performs such an error operation, two pairs of lamp pins 230 in a lamp 200 hit the edges of the two guide slits 800, respectively, and a load is added to each of the lamp pins 230 and the supporters 6. At this time, if the user does not stop rotating the lamp 230, the lamp 230 or a supporter 6 is damaged. For example, lamp pins 230 are folded. Or a guide slit 800 is spread and then the outer cover 8 is broken.

The lamp socket of the second embodiment has the same attachment and detachment mechanism as that of the first embodiment, and can prevent breakage of a lamp and a supporter, caused by the aforementioned error operation.

That is, the lamp socket 1 of the second embodiment is used to define the mounting position of a lamp to luminaire and fix the lamp placed at the mounting position like the first embodiment. A lamp socket 1 also has a mover 2 and a supporter 6, and can energize the lamp fixed at the mounting position. The supporter 6 is different from that of the first embodiment. The other structure is the same as that of the first embodiment and is not described in detail herein.

As shown in FIG. 9, an outer cover 8 of the supporter 6 is formed with a guide opening 804 in stead of the guide slit 800 of the first embodiment. This guide opening 804 is in a shape that two recess cuts 805 are formed at both sides of the central part of a guide slit 800. The two recess cuts 805 are formed so that, when a straight tube fluorescent lamp at the mounting position is rotated around the axis of the lamp tube, two corresponding lamp pins can enter the two recess cuts 805, respectively. In short, the supporter 6 of the second embodiment is different from the first embodiment, in that the two recess cuts 805 are further provided. Also, the supporter 6 of the second embodiment is not provided with a physical axis corresponding to the axis 801 of the first embodiment (see FIG. 4), but has a center (rotation) axis obtained from the circular cylindrical shape.

Figure 11A:
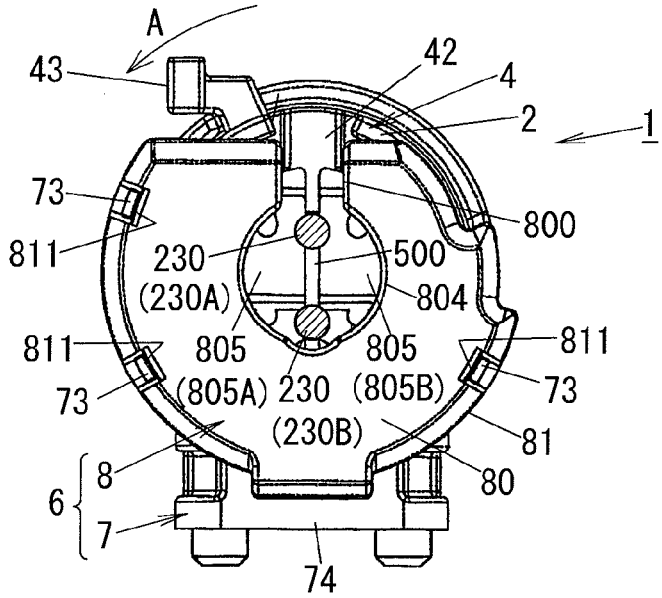
FIGS. 11A through 11C are explanatory diagrams of the lamp socket in FIG. 9.

In the example of FIG. 9, the two recess cuts 805 are formed so as to permit a lamp at the mounting position to be rotated by 360 degrees in the movement direction of the mover 2. Specifically, the upper part (800) of the guide opening 804 has the width that is narrower than the interval of two lamp pins 230 and little bit larger than each diameter of the lamp pins 230. Each recess cut 805 is in the shape of an outline curving out, and thereby the guide opening 804 has a circular part. This circular part has the center corresponding to the rotation axis of the mover 2 and a diameter larger than the interval of two lamp pins. The left and right recess cuts are hereinafter denoted by 805A and 805B, respectively as shown in FIG. 9, etc. As shown in FIG. 11A, in order to distinguish two lamp pins 230, the upper and lower lamp pins immediately after the lamp is placed at the mounting position along the specified direction are denoted by 230A and 230B, respectively.

Even in the second embodiment, as shown in FIG. 11A, a mover 2 must be at the open position in order to place a lamp at the mounting position of luminaire along the specified direction. That is, when the movers 2 are at the open positions, the lamp is moved along the specified direction and then the two pairs of lamp pins 230 are inserted into the pin inserted holes 500 from the side of the lead-in mouths 42 in the depth directions of the guide openings 804. Subsequently, if the movers 2 are moved to the close positions through the operational levers 43, the lamp is fixed to the mounting position and it is possible to energize the lamp.

Figure 11B:
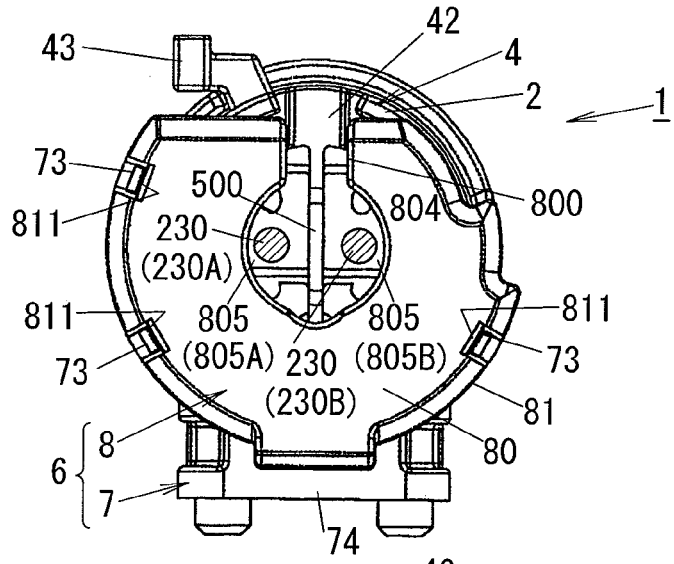
Figure 11C:
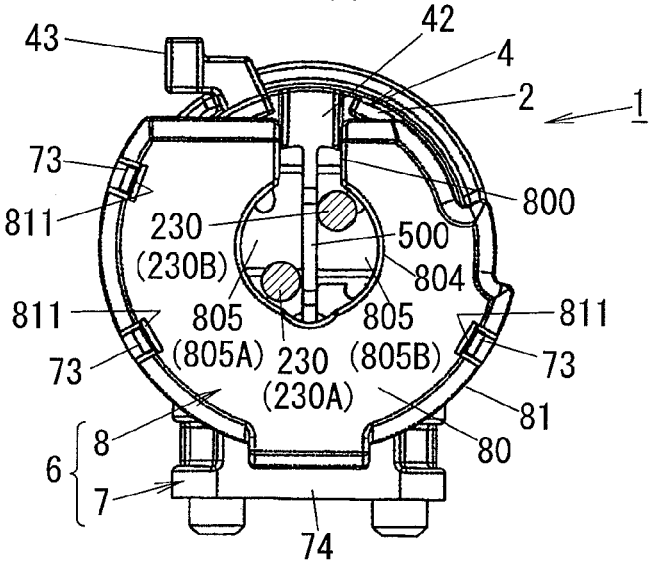

However, even if not the movers 2 but the lamp (straight tube fluorescent lamp) is rotated around the axis of the lamp tube as shown in the arrow A of FIG. 11A, each two lamp pins 230 can enter two corresponding recess cuts 805, respectively. Specifically, as shown in FIG. 11B, the lamp pins 230A and 230B can enter the recess cuts 805A and 805B, respectively. Therefore, even if the lamp at the mounting position is rotated around the axis of the lamp tube, large stress does not occur between the outer cover 8 and each lamp pin 230. The lamp pins 230A and 230B are also in contact with and electrically connected with the two contacts 30, respectively, when being moved to the position of FIG. 11B. At this point, the lamp pins 230A and 230B are fit into and fixed to the two pin holders 302, respectively. In addition, since the upper part of the guide opening 804 is narrower than the interval of the lamp pins 230A and 230B, the lamp cannot pass through the upper part. If the lamp is rotated in the direction of the arrow A from the position of FIG. 11B, the lamp pins 230A and 230B move to the bottom and top sides of the guide opening 804 as shown in FIG. 11C, respectively and move to the position of ½ rotation later on. Also in this instance, large stress does not occur between the outer cover 8 and each lamp pin 230.

Similarly, even if the lamp is rotated in the opposite direction of the arrow A, each two lamp pins 230 can enter two corresponding recess cuts 805, respectively. That is, the lamp pins 230A and 230B can enter the recess cuts 805B and 805A, respectively, and large stress does not occur between the outer cover 8 and each lamp pin 230. When the lamp is rotated by substantially 90 degrees, the lamp pins 230A and 230B are fit into and fixed to the two pin holders 302, respectively. Also in this instance, the lamp cannot pass through the upper part of the guide opening 804. When the lamp is further rotated in the opposite direction of the arrow A, the lamp pins 230A and 230B move to the bottom and top sides of the guide opening 804, respectively and move to the position of ½ rotation later on. Also in this instance, large stress does not occur between the outer cover 8 and each lamp pin 230.

In the second embodiment, as shown in FIG. 9, the two contacts 30 are arranged opposite to each other behind the guide opening 804 so as to have a wider interval than the upper part of the guide opening 804. Accordingly, the lamp pins 230 at the position of FIG. 11A can be freely moved along the guide opening 804 without contact with the two contacts 30. Therefore, when the movers 2 are at the open positions as shown in FIG. 11A, the lamp can be inserted into or removed from the mounting position of luminaire along the specified direction. Expanding on the above, when the lamp is placed at the mounting position along the specified direction, each two lamp pins 230 are inserted into the pin insertion hole 500 from the lead-in mouth 42 side along the guide opening 804. The mover 2 at the position of FIG. 11A is then moved to the close position, and thereby the two contacts 30 are rotated by substantially 90 degrees to make contact with the two lamp pins 230 at the position of FIG. 11A, respectively. At this point, the lead-in mouth 42 is also rotated by substantially 90 degrees to be moved from the guide opening 804 and the top of the guide opening 804 is closed with the mover 2, so that the two lamp pins 230 are fixed to the mounting position. Thus, like the first embodiment, the lamp can be fixed to the mounting position without being rotated, while making it possible to energize the lamp at the same time.

In addition, even if the lamp at the position of FIG. 11A is rotated, each two lamp pins 230 enter two corresponding recess cuts 805, respectively, and accordingly large stress does not occur between the outer cover 8 and each lamp pin 230. Thereby, when a lamp is attached or detached, breakage of a lamp and a supporter 6 caused by the error operation can be prevented. Therefore, in the luminaire 250 having lamp sockets 1 of the second embodiment, a lamp can be attached to or detached from the mounting position like the first embodiment. Moreover, when the lamp is attached or detached, breakage of a lamp and a supporter 6 caused by the error operation can be prevented.

In an embodiment, a lamp socket 10 shown in FIGS. 12A, 12B, 13A and 13B is employed in stead of one of the two lamp sockets 1. The lamp socket 10 includes a housing 11 fixed to the body of luminaire. The housing 11 has a pin insertion hole 130 into which two lamp pins of a lamp placed at the mounting position of the luminaire are inserted.

Figure 12A:
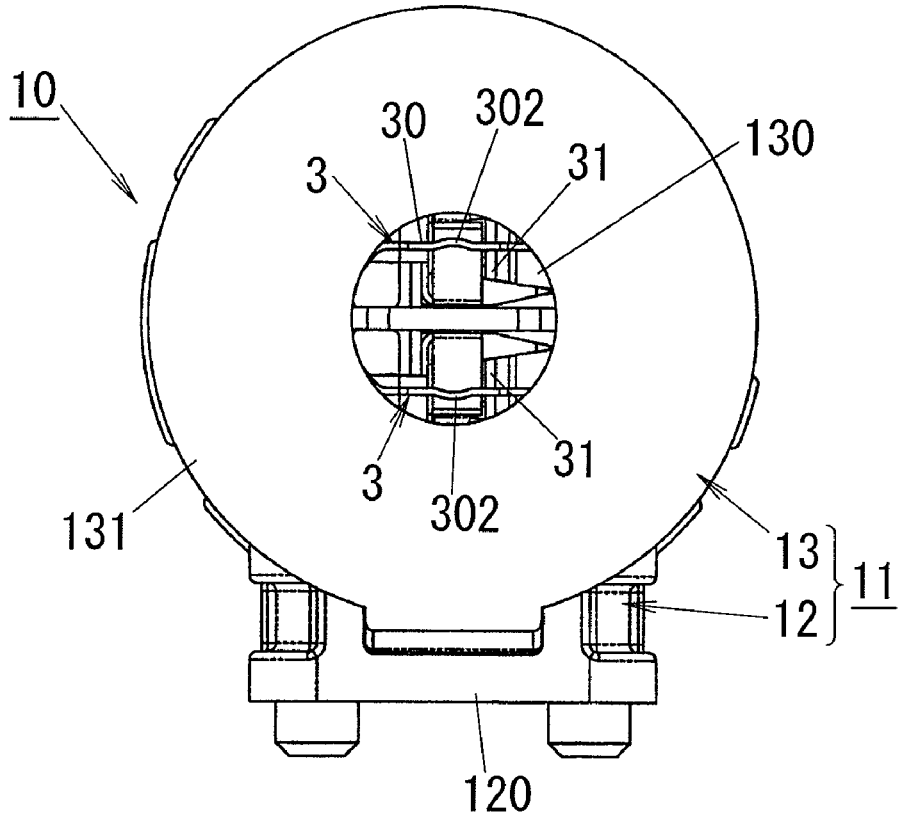
FIGS. 12A and 12B illustrate a lamp socket that can be used together with the lamp socket in FIG. 9.

This housing 11 is also provided therein with two conductive plates 3 arranged opposite to each other like the lamp socket 1, but the two conductive plates 3 are rotated by substantially 90 degrees to be laterally arranged as shown in FIG. 12A. Two contacts 30 and two terminals 31 are also put in the housing 11 and respectively arranged at the front and the rear of the housing 11.

Figure 12B:
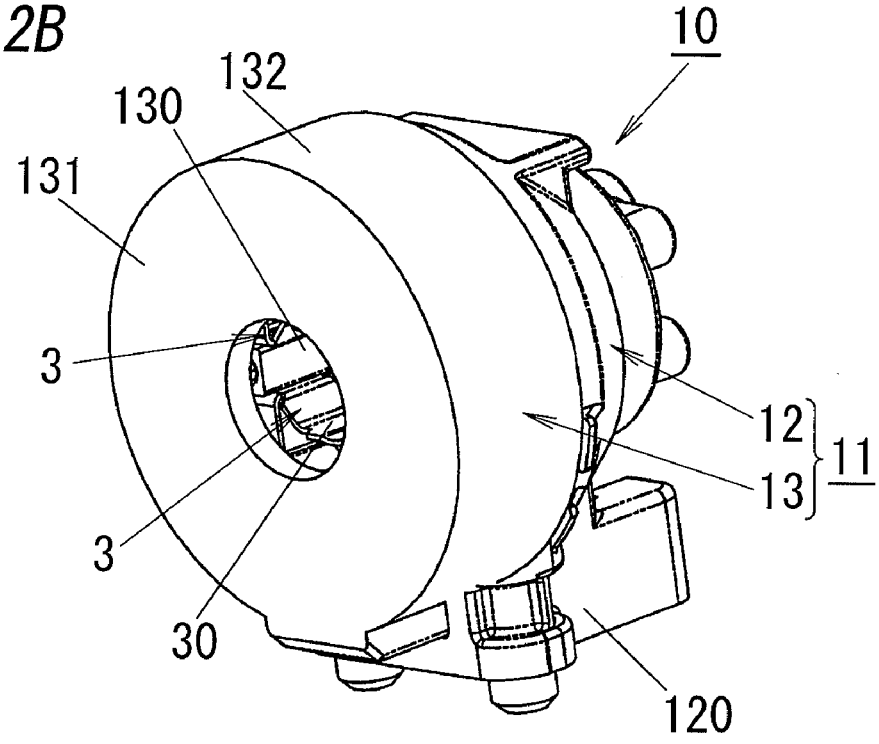

As shown in FIG. 12B, the housing 11 is formed of a body 12 and a cover 13. Each of the body 12 and the cover 13 is a synthetic resin molding made of resin material for insulation. The cover 13 is attached to the front of the body 12 in which the two conductive plates 3 are put.

The body 12 is formed into a cylindrical shape having an opening and a bottom arranged at its own front and rear, respectively. The body 12 also has two insertion holes (not shown) that are pierced in the bottom of the body 12 and are respectively arranged behind the two terminals 31. Therefore, if two conductors of an electric wire are inserted into the two insertion holes, respectively, the two conductors are connected with the two terminals 31, respectively. The base 120 of the body 12 is fixed to the body of the luminaire by means such as, for example, screw fixation or the like.

The cover 13 has a front wall 131 and a peripheral wall 132. The front wall 131 is in the shape of a disk that covers the opening of the body 12. The cover 13 also has the aforementioned pin insertion hole 130 that is pierced in the front wall 131. The pin insertion hole 130 has a diameter larger than the interval (outer width) of the two lamp pins 230 so that the contacts 30 of the two conductive plates 3 in the body 12 are exposed. Therefore, when the two lamp pins 230 are inserted into the pin insertion hole 130, the lamp 200 can be rotated by 360 degrees around the center axis of the pin insertion hole 130. The peripheral wall 132 is projected backward from the outer edge of the front wall 131. This cover 13 is combined with and fixed to the body 12 so that the front side of the body 12 is inserted into the peripheral wall 132.

Figure 13A:
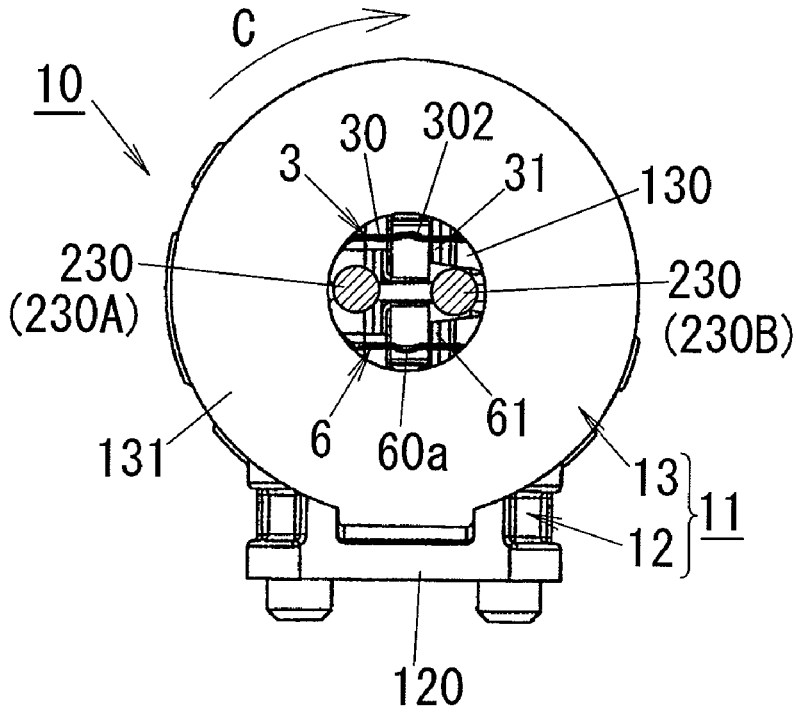
FIGS. 13A and 13B are explanatory diagrams of operation of the lamp socket in FIG. 12.
Figure 13B:
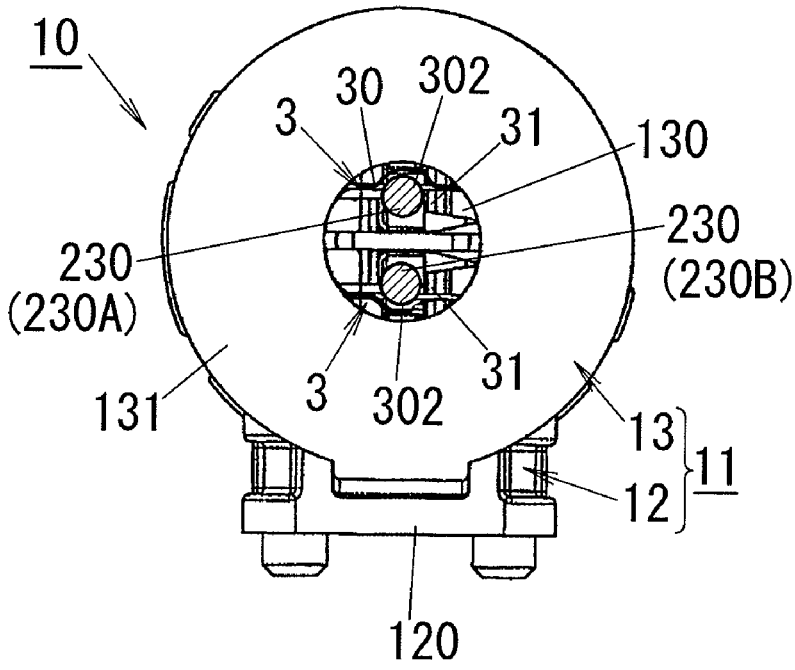

In the lamp socket 10, as shown in FIG. 12A, the two conductive plates 3 are put in the housing 11 so that the two contacts 30 are arranged opposite to each other. Therefore, as shown in FIG. 13A, the two lamp pins 230 are inserted into the housing 11 through the pin insertion hole 130. That is, the two lamp pins 230 are arranged in the length direction of each contact 30 and then inserted between the two contacts 30. The lamp is then rotated around the center axis of the pin insertion hole 130 in the direction of, for example, the arrow C (clockwise direction). Subsequently, the two lamp pins 230 are fit into the two pin holders 302, respectively, and thereby one end side of the lamp is fixed to the lamp socket 10.

The luminaire of the embodiment is provided with the lamp socket 10 and, for example, the lamp socket 1 of the second embodiment. Attachment of a lamp 200 to this luminaire is explained. First, the mover 2 of the lamp socket 1 is set to the open position. Two lamp pins 230 of one base of the lamp are then inserted into the housing 11 through the pin insertion hole 130 as shown in FIG. 13A. Subsequently, the lamp 200 is rotated around the center axis of the pin insertion hole 130, and two lamp pins 230 of the other base are inserted into the pin insertion hole 500 from the side of the lead-in mouth 42 along the guide opening 804. Finally, the mover 2 is rotated from the open position to the close position.

Thus, the lamp sockets 1 and 10 are employed and thereby the number of times that the mover 2 is operated can be reduced to one time. Accordingly, the lamp can be easily attached to and also detached from the mounting position of the luminaire. When the lamp is placed at the mounting position, the lamp doesn't need to be rotated and accordingly the lamp placed at the mounting position can be easily fixed even if the space around the lamp is narrow. The lamp socket 10 is simple structure, few number of parts and low production cost in comparison with the lamp socket 1 of the second embodiment, and therefore production cost of the whole luminaire can be reduced.

Each lamp socket 1 of the first and second embodiments is not limited to the above examples, but can be modified without departing from the spirit of the invention. The lamp socket 1 is also not limited to the luminaire 250 for the lamp 200 shown in FIGS. 8A and 8B. For example, the lamp socket 1 can be also used for luminaire for a straight tube fluorescent lamp shown in FIG. 2, or the like, and is not limited to especially kinds of luminaire. The lamp socket 10 of FIG. 12A can be combined with, but not limited to the lamp socket 1 of the second embodiment, any lamp socket except the lamp socket 10.

Figure 14:
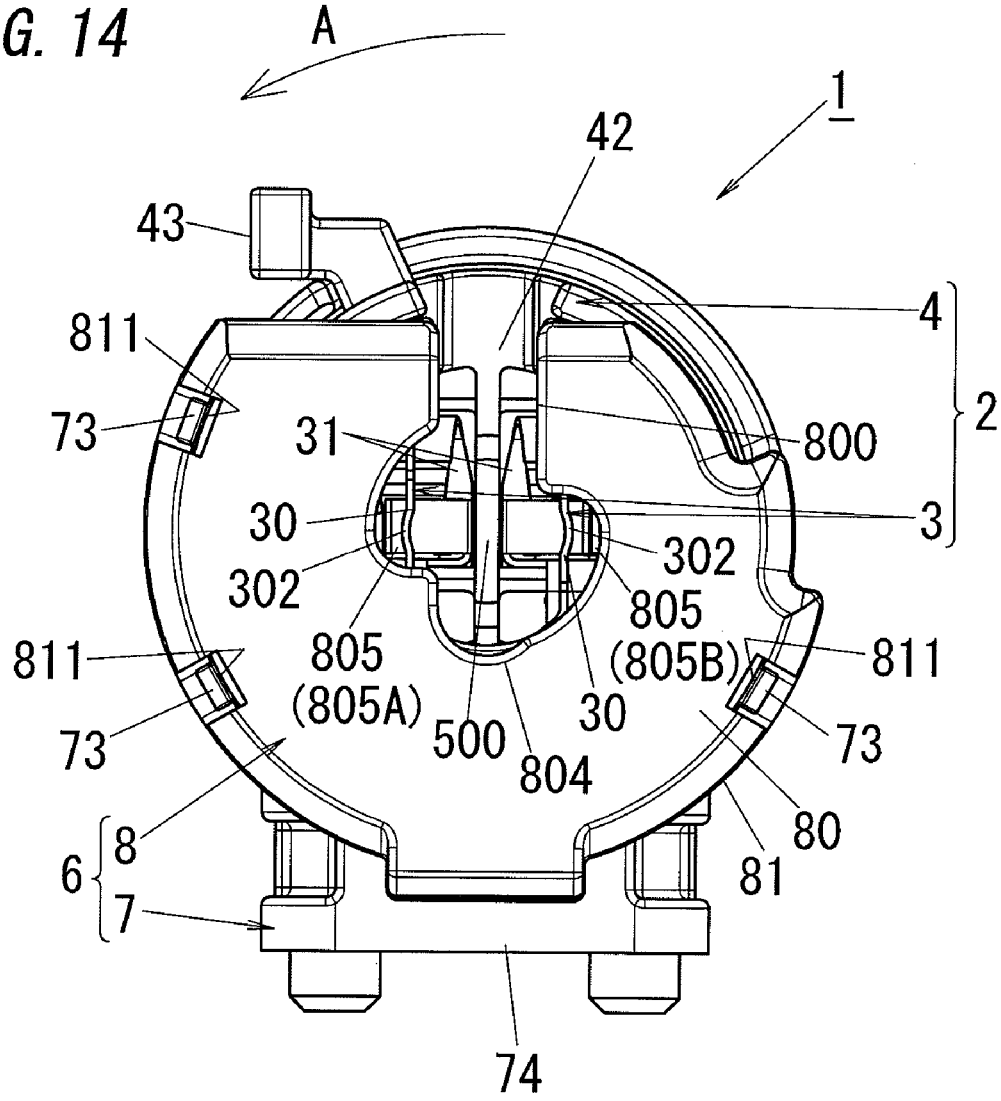
FIG. 14 is a front view of a lamp socket in accordance with a third embodiment of the present invention.

FIG. 14 shows a lamp socket 1 in accordance with a third embodiment of the present invention. This lamp socket 1 is formed in the same way as the second embodiment except that each shape of two recess cuts 805 of the third embodiment is different from that of the second embodiment. Accordingly, the same structure as the second embodiment is not described in detail herein.

As shown in FIG. 14, the two recess cuts 805 of the third embodiment are formed so that a lamp (e.g., straight tube fluorescent lamp) placed at the mounting position of luminaire can be rotated by substantially 90 degrees in the movement direction of the mover 2. In the example of FIG. 14, the two recess cuts 805 are formed so that the lamp can be rotated by substantially 90 degrees in the direction of the arrow A (counterclockwise direction).

Specifically, the two recess cuts 805 are formed into a sector having a central angle of substantially 90 degrees each, and arranged to be symmetric with respect to the center of the circle corresponding to the outline of the outer cover 8. The distance between both arcs of the two recess cuts 805 (diameter) is also set to a larger dimension than the interval of the two lamp pins 230.

Figure 15A:
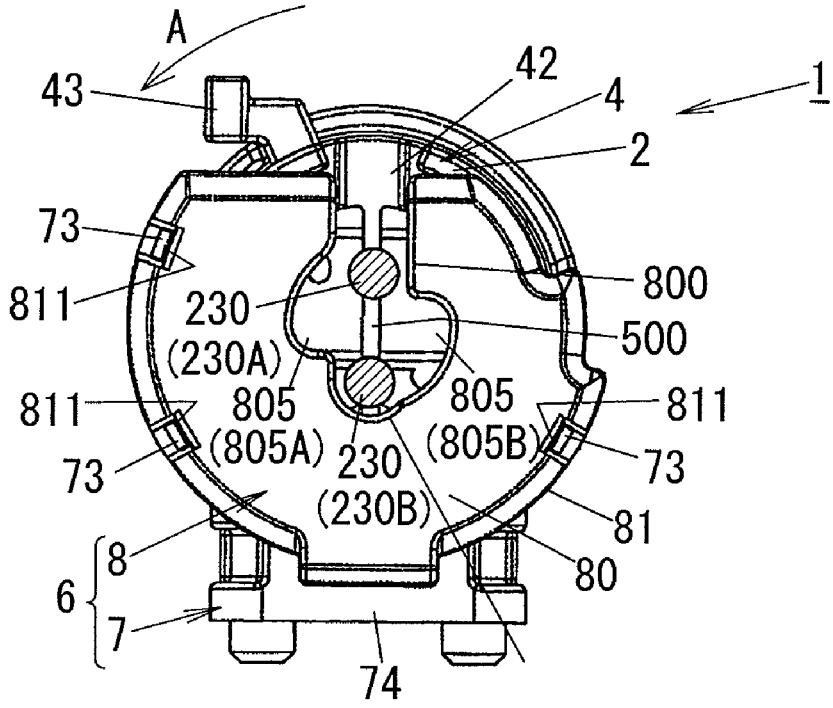
FIGS. 15A and 15B are explanatory diagrams of operation of the lamp socket in FIG. 14.
Figure 15B:
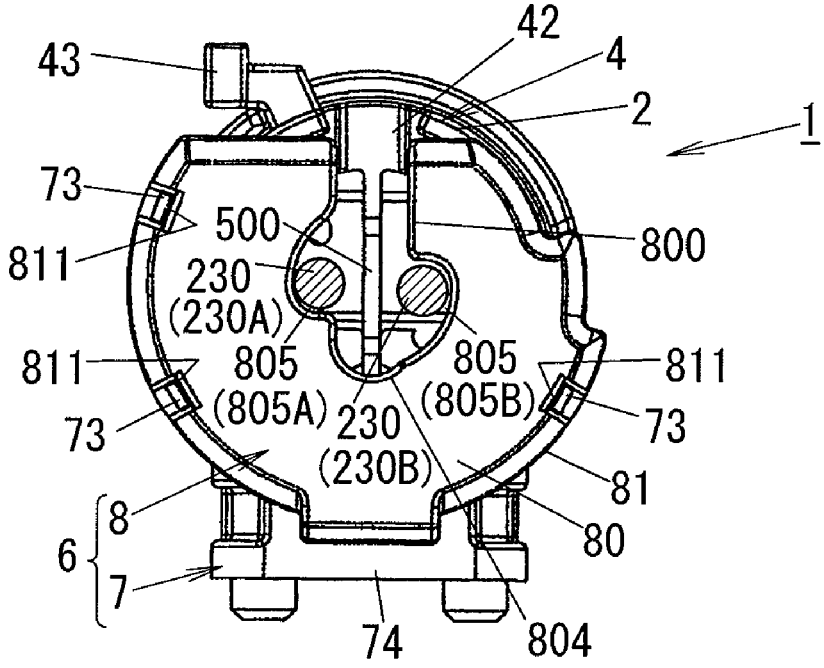

In the third embodiment, as shown in FIG. 15A, when the mover 2 is at the open position, the two lamp pins 230 are arranged in the depth direction of the guide opening 804 and inserted into the pin insertion hole 500 from the side of the lead-in mouth 42 along the depth direction. At this point, the lamp can be hardly rotated clockwise but can be rotated in the direction of the arrow A (counterclockwise direction). Moreover, even if the lamp is rotated counterclockwise, the lamp pins 230A and 230B enter the two recess cuts 805A and 805B, respectively as shown in FIG. 15B. Accordingly, until the lamp is rotated by substantially 90 degrees, large stress does not occur between the outer cover 8 and each lamp pin 230. When being rotated up to the position of FIG. 15B, the two lamp pins 230 are fit into the two pin holders 302 and thereby electrically connected with the two contacts 30, respectively. The upper part of the guide opening 804 is also narrower than the interval of the two lamp pins 230 and accordingly the lamp cannot pass through the upper part.

Each recess cut 805 of the third embodiment can be reduced in comparison with that of the second embodiment. Accordingly, the mover 2 having the contacts 30 can be preferably put in the supporter 6 in which the guide opening 804 having the smaller recess cuts 805 is formed. The lamp can be also rotated around the axis of the lamp tube by substantially 90 degrees, and accordingly a user can notice an operational error or recognize that the lamp is fully rotated. Therefore, the lamp socket in the third embodiment can have performance almost equal to the lamp socket of the second embodiment having the recess cuts 805 formed so that a lamp can be rotated over 90 degrees (e.g., capability for breakage prevention of each lamp pin and a lamp socket). Furthermore, the lamp can be fixed to the mounting position without being rotated, while making it possible to energize the lamp at the same time.

In an alternate example, the two recess cuts are formed so that a lamp can be rotated by substantially 90 degrees in the clockwise direction. However, not limited to 90 degrees, each recess cut may be a shape having an angle so that two lamp pins 230 can make contact with the two contacts 30, respectively. This shape can be modified according to conditions.

Figure 16:
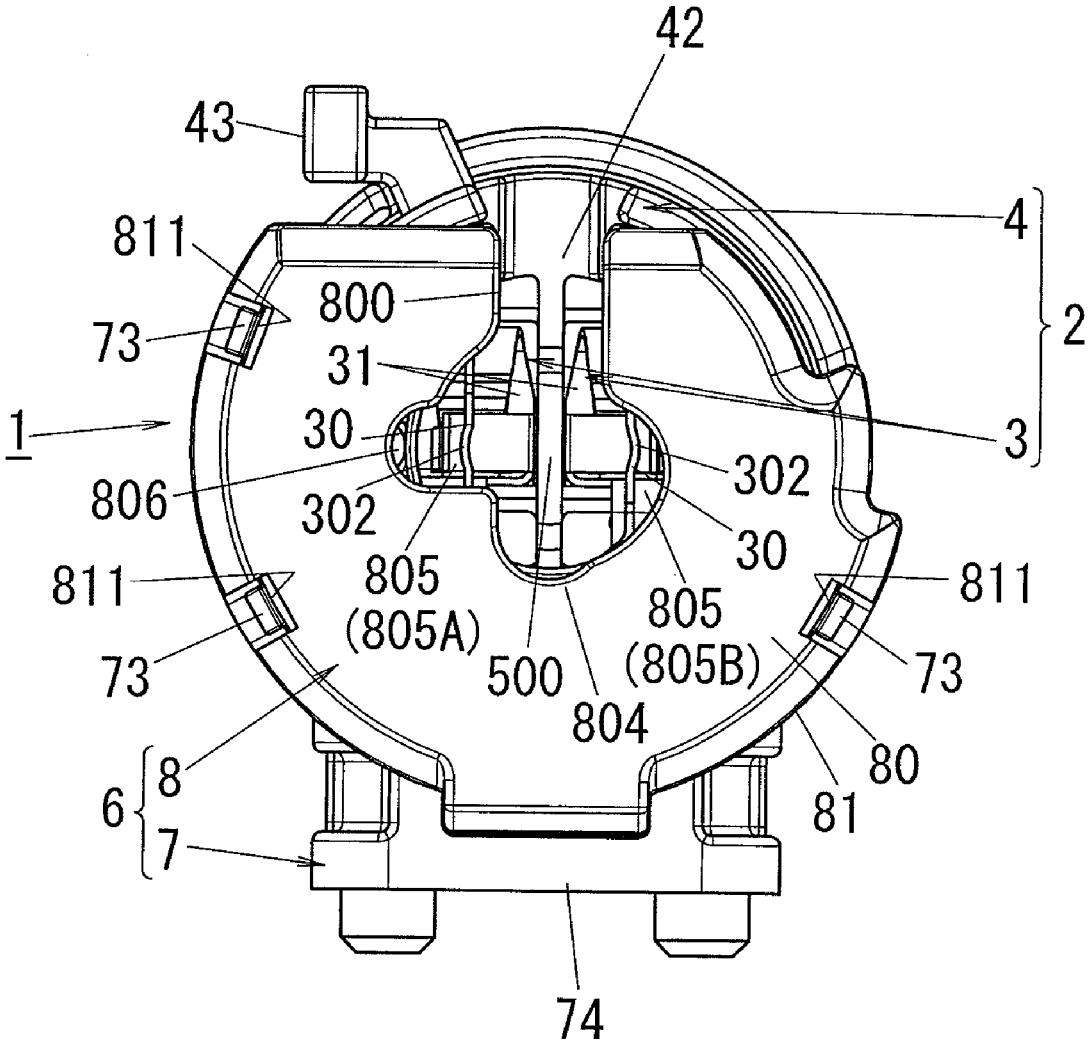
FIG. 16 is a front view of a lamp socket in accordance with a fourth embodiment of the present invention.

FIG. 16 shows a lamp socket 1 in accordance with a fourth embodiment of the present invention. This lamp socket 1 is formed in the same way as the third embodiment except that the shape of a guide opening 804 of an outer cover 8 is different from that of the third embodiment. Accordingly, the same structure as the third embodiment is not described in detail herein.

As shown in FIGS. 16, 17A-17C and 18A-18C, the guide opening 804 in the fourth embodiment has two recess cuts

805 formed like the third embodiment, and a guide cut 806 joined to one of the two recess cuts 805. This guide cut 806 is joined to the recess cut 805A which the lamp pin 230A enters when a lamp is rotated in the direction of the arrow A (counterclockwise direction). In addition, when the lamp is rotated over substantially 90 degrees, the guide cut 806 is formed so that the lamp pin 230A enters the guide cut 806 from the recess cut 805A while guiding the lamp pin 230B to the top side of the guide opening 804.

Figure 17C:
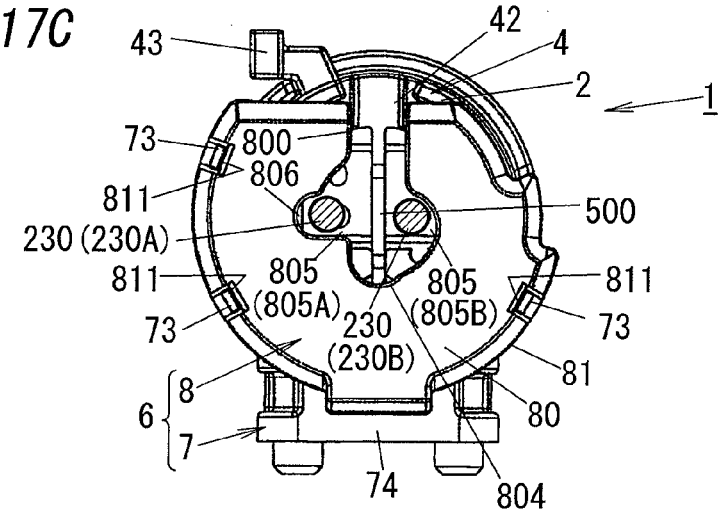
Figure 18A:
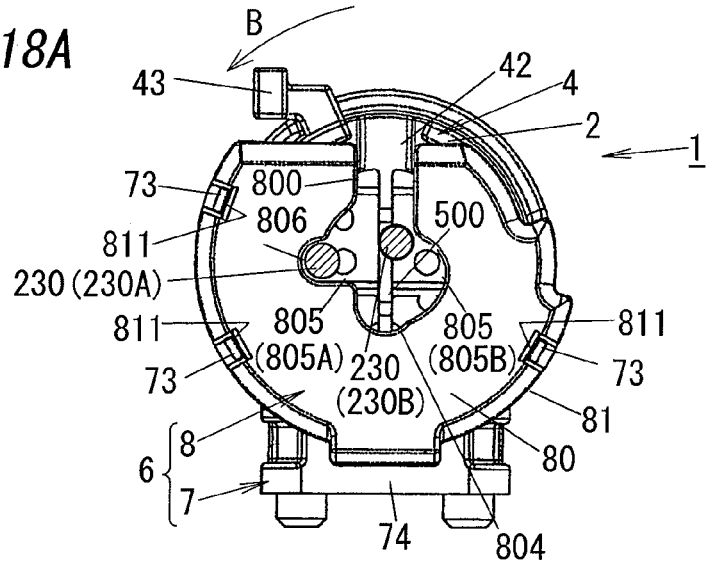
FIGS. 18A through 18C are explanatory diagrams of operation of the lamp socket in FIG. 16.

Specifically, the guide cut 806 is in the shape of a semicircle extended outward (the left direction in FIG. 17C) from the pin holder 302 side corresponding to the lamp pin 230A in the recess cut 805A (cf. FIG. 9). The diameter of the semicircle shaped guide cut 806 is set to a slightly larger value than that of each lamp pin 230. As shown in FIGS. 17C and 18A, the guide cut 806 is extended so that the contact 30 is pressed with the lamp pin 230A to be bent and thereby the lamp pin 230A can be moved leftward, while the lamp pin 230B can be moved from the recess cut 805B to the upper part of the guide opening 804 at the same time. On account of this, the boundary between the recess cut 805B and the upper part is in the shape of a rounded surface.

Figure 17A:
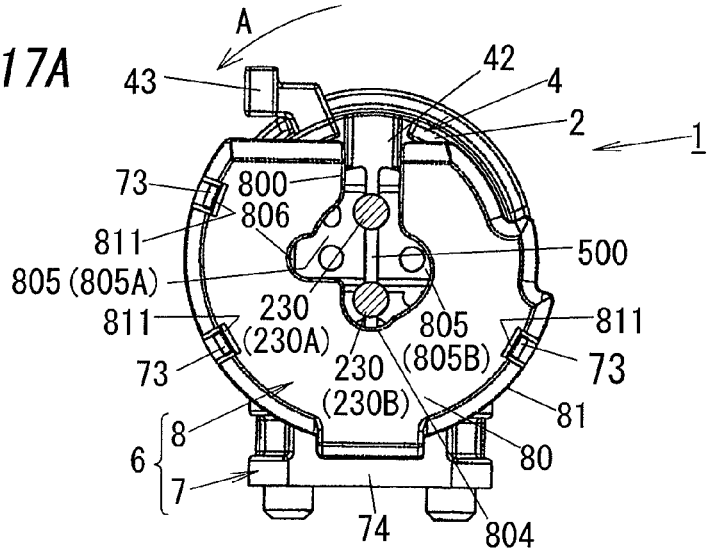
FIGS. 17A through 17C are explanatory diagrams of operation of the lamp socket in FIG. 16.
Figure 17B:
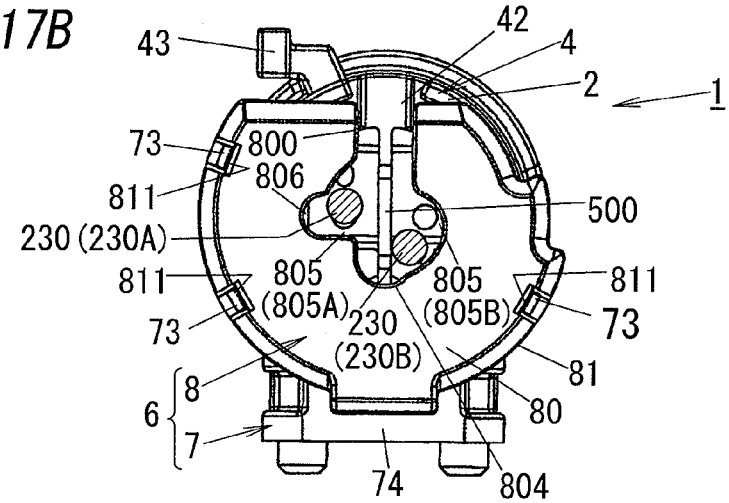

In the fourth embodiment, as shown in FIG. 17A, when the mover 2 is at the open position, the two lamp pins 230 are arranged in the depth direction of the guide opening 804 and inserted into the pin insertion hole 500 from the lead-in mouth 42 side along the depth direction. At this point, the lamp can be hardly rotated clockwise but can be rotated in the direction of the arrow A (counterclockwise direction). Moreover, even if the lamp is rotated counterclockwise, the lamp pins 230A and 230B enter the two recess cuts 805A and 805B, respectively as shown in FIG. 17B. Accordingly, until the lamp is rotated by substantially 90 degrees, large stress does not occur between the outer cover 8 and each lamp pin 230. If being rotated up to the position of FIG. 17C, the two lamp pins 230 are fit into the two pin holders 302 and thereby electrically connected with the two contacts 30, respectively. The upper part of the guide opening 804 is also narrower than the interval of the two lamp pins 230 and accordingly the lamp cannot pass through the upper part.

Figure 18B:
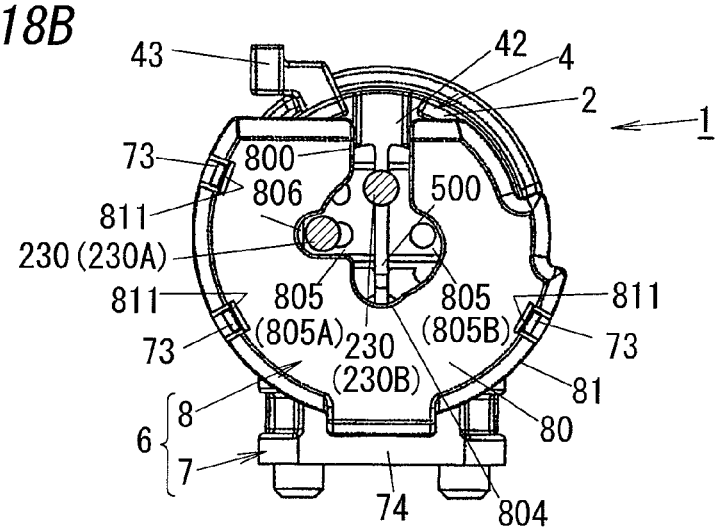
Figure 18C:
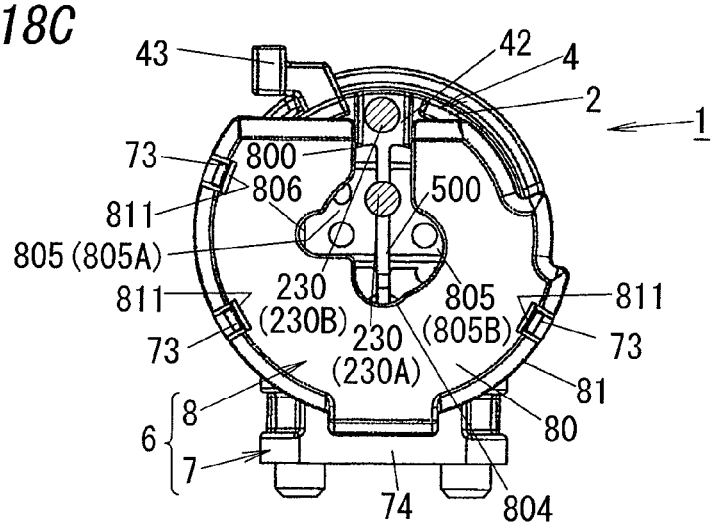

Subsequently, when the lamp is further rotated counterclockwise, the lamp pin 230B touches the recess cut 805B and thereby the lamp pin 230A presses and bends the contact 30 and then moves leftward to enter the guide cut 806. Consequently, the lamp pin 230B passes over the boundary between the recess cut 805B and the upper part of the guide opening 804, and then moves to the guide opening 804 (FIGS. 17C and 18A-18B). Afterwards, as shown in FIG. 18C, the two lamp pins 230 can be pulled out of the guide opening 804 via the lead-in mouth 42.

In the fourth embodiment, the guide opening 804 is only provided with one guide cut 806, and thereby a lamp can be rotated over 90 degrees. Accordingly, breakage of a lamp and the supporter 6 can be prevented preferably in comparison with the third embodiment. Since the guide opening 804 is only provided with one guide cut 806, increase of the area of the guide opening 804 can be suppressed. Furthermore, the lamp can be fixed to the mounting position without being rotated while making it possible to energize the lamp at the same time.

Although the present invention has been described with reference to certain preferred embodiments, numerous modifications and variations can be made by those skilled in the art without departing from the true spirit and scope of this invention.

The invention claimed is:

1. A lamp socket for defining a mounting position of a lamp to luminaire and fixing the lamp placed at the mounting position, the lamp having lamp pins for power supply, which project from a base, said lamp socket comprising:

a mover having therein contacts which can be electrically connected with the lamp pins, respectively; and a supporter supporting the mover so that the mover can be moved between predetermined open and close positions, wherein the supporter supports the mover so that the mover does not prevent the lamp from being moved to or from the mounting position along a specified direction if the mover is at the open position, the specified direction being a direction intersecting with a projection direction of the lamp pins when the lamp is at the mounting position, wherein the supporter supports the mover so that the contacts do not make contact with the lamp pins, respectively, if the mover is at the open position and the lamp is in a posture by which it can be moved from the mounting position along the specified direction, wherein the supporter supports the mover so that the mover prevents the lamp from being moved from or to the mounting position along the specified direction if the mover is at the close position, wherein the supporter supports the mover so that the contacts make contact with the lamp pins, respectively, if the mover is at the close position and a posture of the lamp is the same as said posture of the open position, wherein the lamp has two lamp pins as said lamp pins, wherein the mover comprises two contacts as said contacts and a hollow inner body, the two contacts being put in the inner body to be arranged opposite to each other, the inner body being formed into a shape having a rotation axis, the inner body being formed with an operational lever and a lead-in mouth for inserting the two lamp pins between the two contacts, wherein the supporter comprises a cylindrical surface and a facing surface and supports the inner body so that the inner body can be rotated around the rotation axis inside the cylindrical surface, wherein the cylindrical surface has an opening from which the operational lever is projected, wherein the facing surface faces the end face of the base when the lamp is placed at the mounting position, the facing surface being formed with a guide slit which is in shape of a straight line and joined to the opening of the cylindrical surface, the guide slit having the depth longer than the interval of the lamp pins and the width narrower than the interval, wherein the specified direction corresponds to the direction passing through a top and a bottom of the guide slit when the mover is at the open position, and wherein the direction from the lead-in mouth to the space between the contacts corresponds to the depth direction of the guide slit when the mover is at the open position, and also intersects with the depth direction when the mover is at the close position.

2. The lamp socket of claim 1, wherein the opening of the cylindrical surface restricts the rotation range of the operational lever to the range between the open and close positions.

3. The lamp socket of claim 1, wherein the mover comprises two insertion holes pierced in the inner body in the direction of the rotation axis, and wherein the two contacts are electrically connected to two conductors of electric wires, inserted into the two insertion holes, respectively.

4. The lamp socket of claim 2, wherein the mover comprises two insertion holes pierced in the inner body in the direction of the rotation axis, and wherein the two contacts are electrically connected to two conductors of electric wires, inserted into the two insertion holes, respectively.

5. A lamp socket for defining a mounting position of a lamp to luminaire and fixing the lamp placed at the mounting position, the lamp having lamp pins for power supply, which project from a base, said lamp socket comprising:

a mover having therein contacts which can be electrically connected with the lamp pins, respectively; and a supporter supporting the mover so that the mover can be moved between predetermined open and close positions, wherein the supporter supports the mover so that the mover does not prevent the lamp from being moved to or from the mounting position along a specified direction if the mover is at the open position, the specified direction being a direction intersecting with a projection direction of the lamp pins when the lamp is at the mounting position, wherein the supporter supports the mover so that the contacts do not make contact with the lamp pins, respectively, if the mover is at the open position and the lamp is in a posture by which it can be moved from the mounting position along the specified direction, wherein the supporter supports the mover so that the mover prevents the lamp from being moved from or to the mounting position along the specified direction if the mover is at the close position, wherein the supporter supports the mover so that the contacts make contact with the lamp pins, respectively, if the mover is at the close position and a posture of the lamp is the same as said posture of the open position, wherein the lamp has two lamp pins as said lamp pins, wherein the mover comprises two contacts as said contacts and a hollow inner body, the two contacts being put in the inner body to be arranged opposite to each other, the inner body being formed into a shape having a rotation axis, the inner body being formed with an operational lever and a lead-in mouth for inserting the two lamp pins between the two contacts, wherein the supporter comprises a cylindrical surface and a facing surface and supports the inner body so that the inner body can rotate around the rotation axis inside the cylindrical surface, wherein the cylindrical surface has an opening from which the operational lever is projected, wherein the facing surface faces the end face of the base when the lamp is placed at the mounting position, the facing surface being formed with a guide opening joined to the opening of the cylindrical surface, the guide opening having the depth longer than the interval of the lamp pins, wherein the specified direction corresponds to the direction passing through a top and a bottom of the guide opening when the mover is at the open position, wherein the direction from the lead-in mouth to the space between the contacts corresponds to the depth direction of the guide opening when the mover is at the open position, and also intersects with the depth direction when the mover is at the close position, and wherein the guide opening comprises a recess cut where the two lamp pins enter when the lamp placed at the mounting position is rotated in the movement direction of the mover.

6. The lamp socket of claim 5, wherein the guide opening has two recess cuts as said recess cut, the two recess cuts being formed so that the lamp placed at the mounting position can be rotated by substantially 90 degrees in the movement direction of the mover.

7. The lamp socket of claim 6, wherein the guide opening further comprises a guide cut joined to first recess cut of first and second cuts as said two recess cuts, and wherein the guide cut is formed so that a lamp pin in the first cut enters the guide cut from the first cut while guiding a lamp pin in the second cut to the top side of the guide opening, when the lamp is rotated over substantially 90 degrees.

8. Luminaire, comprising lamp socket of claim 1.

9. Luminaire, comprising lamp socket of claim 2.

10. Luminaire, comprising lamp socket of claim 3.

11. Luminaire, comprising lamp socket of claim 4.

12. Luminaire, comprising lamp socket of claim 5.

13. Luminaire, comprising lamp socket of claim 6.

14. Luminaire, comprising lamp socket of claim 7.

* * * * *